US006447085B1

(12) United States Patent
Yagi et al.

(10) Patent No.: US 6,447,085 B1
(45) Date of Patent: Sep. 10, 2002

(54) DRIVING METHOD OF INK-JET RECORDING HEAD, AND RECORDING APPARATUS FOR PERFORMING THE DRIVING METHOD

(75) Inventors: Takayuki Yagi; Yasuyuki Tamura, both of Yokohama; Akira Asai, Atsugi; Tatsuo Furukawa; Katsuhiko Shinjo, both of Isehara; Hidenori Watanabe, Zama; Mamoru Tsukada, Fujisawa; Yoshimasa Okamura, Odawara, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/515,854

(22) Filed: Feb. 29, 2000

(30) Foreign Application Priority Data

Mar. 1, 1999 (JP) ..... 11-052583

(51) Int. Cl.[7] ..... D41J 29/38
(52) U.S. Cl. ..... 347/9; 347/10; 347/11
(58) Field of Search ..... 347/9, 11, 56, 347/57, 60, 14

(56) References Cited

U.S. PATENT DOCUMENTS

| | | | | |
|---|---|---|---|---|
| 4,490,728 A | | 12/1984 | Vaught et al. | |
| 5,218,376 A | | 6/1993 | Asai | |
| 5,477,246 A | * | 12/1995 | Hirabayashi et al. | 347/12 |
| 5,729,260 A | | 3/1998 | Mitani et al. | |

FOREIGN PATENT DOCUMENTS

| | | | |
|---|---|---|---|
| EP | 0 580 165 | 1/1994 | B41J/2/05 |
| EP | 0 838 333 | 4/1998 | B41J/2/05 |
| JP | 55-126462 | 9/1980 | |
| JP | 5-116341 | 5/1993 | B41J/2/205 |

OTHER PUBLICATIONS

Asai et al., "Bubble Generation Mechanism in the Bubble Jet Recording Process", Journal of Imaging Technology, vol. 14, No. 5, pp. 120–124, Oct. 1988.

Rayleigh, "On the Pressure Developed in a Liquid During the Collapse of a Spherical Cavity", Philosophical Magazine and Journal of Science, vol. 34, pp. 94–98, Aug. 1917.

A. Asai, "Application of the Nucleation Theory to the Design of Bubble Jet Printers", Japanese Journal of Applied Physics, vol. 28, No. 5, p. 909–915, May 1989.

A. Asai, "Bubble Dynamics in Boiling Under High Heat Flux Pulse Heating", ASME Journal of Heat Transfer, vol. 113, pp. 973–979, Nov. 1991.

* cited by examiner

*Primary Examiner*—John Barlow
*Assistant Examiner*—Alfred E Dudding
(74) *Attorney, Agent, or Firm*—Fitzpatrick, Cella, Harper & Scinto

(57) ABSTRACT

In a driving method of an ink-jet recording head, heat is generated by applying a drive signal to a heating element, and this heat is applied to ink to generate a bubble and discharge the ink through a discharge outlet. The drive signal comprises a first drive signal for storing foaming energy in the ink, and a second drive signal for generating a bubble in the ink. The second drive signal has a signal time shorter than the boundary foaming time at which foaming energy decreases in a case of performing foaming only by the second drive signal. The first drive signal is applied prior to the second drive signal in order to compensate for a decrease in foaming energy.

23 Claims, 12 Drawing Sheets

DRIVING METHOD OF INK-JET RECORDING HEAD, AND RECORDING APPARATUS FOR PERFORMING THE DRIVING METHOD

BACKGROUND OF THE INVENTION

1. Field of the Invention

The present invention relates to a driving method of an ink-jet recording head in which thermal energy is made to act on ink and ink is discharged on the basis of a bubble generated thereby, and an ink-jet recording apparatus for performing the recording method.

2. Related Background Art

An ink-jet recording method, in which ink is heated to generate a bubble, ink is discharged on the basis of the generation of the bubble, and it is made to adhere onto a medium to perform image formation, has the advantages that high-speed recording is possible, the recording quality is relatively high, and the generated noise level is low.

In addition, this method has many superior advantages such as color image recording is relatively easy, recording can be performed even on a plain paper or the like, miniaturization of apparatus is feasible, and further, because the discharge outlets of a recording head can be disposed at a high density, a high-resolution and high-quality image can be recorded at a high speed. A recording apparatus using this method has been used as information output means in a copier, a printer, a facsimile, or the like, The general construction of a recording head, in which such an ink-jet recording method is performed, comprises discharge outlets for discharging ink, ink flow passages communicating with them for ink supply and electrothermal transducing elements (heating elements) provided within those ink flow passages for generating thermal energy. Each of the heating elements is generally made of a thin-film resistance element. Thermal energy is generated by electrifying each of the heating elements through electrode wiring in a pulse manner (applying drive pulse).

When an overheated liquid layer for storing foaming energy is to be formed in ink by applying thermal energy to ink near the heating element, in a case that the state of the heating element surface (ink heating surface) has partially changed due to scorching of ink, damage, or the like, or impurities or gas has mixed in the ink, heat is hindered from flowing into the overheated liquid layer because a foaming nucleus has been generated in an early stage of heating. As a result, unevenness of foaming start times in the ink on the heating element surface occurs. Because such unevenness of foaming start times causes unevenness of foaming energy of bubbles, there may arise a change in the discharge quantity or discharge velocity of ink to deteriorate image quality.

Therefore, in order to provide an ink-jet recording head good in reproducibility of discharge characteristics of ink droplets such as discharge velocity, it is required to decrease unevenness of foaming start times. For this purpose, it is important to increase the temperature rise rate dT (t0) at the foaming time t=t0. The reason for this will be described below with reference to FIG. 16.

Although foaming probability of ink depends on the temperature distribution in the ink, it changes from 0 to 1 when the temperature T of the portion at the highest temperature in the ink shifts from the lower temperature side to the higher temperature side of the temperature range T1<T<T2 near the overheat limit. FIG. 16 is a diagram showing a change in the temperature T of ink in contact with a heating element surface being at the highest temperature. When the temperature rise rate at the foaming time t=t0 is dT (t0), unevenness Δt of foaming times is given by:

$$\Delta t \approx \frac{T2 - T1}{dT(to)} \tag{1}$$

Therefore, for decreasing the unevenness Δt of foaming start times, the temperature rise rate dT (t0) should be increased.

For decreasing Δt, it is known that rapid heating is effective in which the temperature of ink near a heating element surface is rapidly heated to the homogeneous nucleation temperature before a foaming nucleus is generated at the boundary surface (or interface) between ink and the heating element surface (A. Asai et al., "Bubble Generation Mechanism in the Bubble Jet Recording Process", Journal of Imaging Technology, Vol. 14, pp. 120-124, 1988).

In case of performing rapid heating, the shorter applying time of the drive signal causes a lesser heat quantity that can fully flow into the ink, at a point in time, and so a lesser thickness of ink (overheated liquid layer) in such an overheated state that a foaming nucleus can grow to a bubble results.

A large quantity of evaporative latent heat required by the overheated liquid layer that has started the homogeneous nucleation in rapid heating is mainly supplied from the heating element side. But, there is ink at a low temperature outside the overheated liquid layer, and a large quantity of heat flows out of the thin overheated liquid layer to the ink side outside the overheated liquid layer, which is at a great difference in temperature from the overheated liquid layer. For this reason, if rapid heating is performed with shortening the applying time (heating time) of the drive signal, the essentially required quantity of evaporative latent heat cannot fully be supplied to the overheated liquid layer.

Therefore, if the heating time is shortened, foaming energy decreases, and it becomes hard to obtain a sufficient discharge velocity. (A. Asai, "Bubble Dynamics in Boiling Under High Heat Flux Pulse Heating", J. Heat Transfer, Vol. 11B, pp. 973-978, 1991; Mitsuya et al., "Nucleus Boiling and Ink Discharge Characteristics in Ultra-rapid Heating", Japan Hardcopy '96, A-40)

As a result, when rapid heating is performed with a shortened heating time, "initial discharge performance" is reduced and there is the possibility of no discharge in the worst case. (In case of performing no ink discharge for a certain time after an ink droplet is discharged through a nozzle, when an ink droplet is next discharged through the nozzle, trouble may arise that stable discharge cannot be performed due to an increase in viscosity of ink, and so printing falls into disorder. The discharge performance of the next droplet is referred to as "initial discharge performance".)

Besides, unevenness in resistance of the thin film resistance bodies of recording heads or unevenness in film thickness of protection layers formed on the thin film resistance bodies, which has not been at issue in conventional driving methods, readily results in unevenness in thickness of overheated liquid layers of the recording heads. This may cause unevenness in discharge quantity, discharge velocity, or the like, of the recording heads. Similarly, if there is a change in resistance of a thin film resistance element while foaming is repeated, it causes a change in discharge characteristics of the same recording head.

As described above, in such a driving method of a rapidly-overheated region in which unevenness of foaming start times can be reduced by rapid heating but foaming energy decreases, the discharge characteristics of recording heads may be unstable and uneven due to small foaming energy, which may deteriorate image quality.

SUMMARY OF THE INVENTION

The present invention has been made to solve the above problems, and aims to provide a driving method of an ink-jet recording head capable of performing stable ink discharge, wherein:

(1) unevenness of foaming start times is small to perform stable foaming; and (2) foaming energy is great to ensure a sufficient discharge quantity and a sufficient discharge velocity, and to provide a recording apparatus in which such recording method is performed.

A driving method of an ink-jet recording head according to the present invention to attain such objects is a driving method of an ink-jet recording head that comprises a discharge outlet for discharging ink, an ink flow passage communicating with said discharge outlet, and a heating element for heating ink in said ink flow passage by applying a drive signal so as to generate a bubble, said head discharging ink through said discharge outlet on the basis of the generation of said bubble, wherein said drive signal comprises a first drive signal for storing foaming energy in ink, and a second drive signal for generating a bubble in ink, and a bubble is generated by applying, to said heating element, the drive signal in which:

when the time from application start of said second drive signal to bubble generation is t=δt, and the boundary foaming time at which foaming energy decreases in case of generating a bubble only by said second drive signal without applying said first drive signal, is t=ts, δt and ts satisfy the relation:

$$\delta t < ts;$$

and, when the applying time of said first drive signal, which is the difference in time from the time at which application of said first drive signal is started, to the time at which said second drive signal is started, is t1, the applying time of said second drive signal is (t2-t1), and the heating quantity (or calorific quantity) of said heating element by the drive signal is Q(t), t1, t2, and Q(t) satisfy:

$$\frac{1}{t1}\int_0^{t1} Q(t)\,dt < \frac{1}{\delta t}\int_{t1}^{t2} Q(t)\,dt.$$

Or, it is a driving method of an ink-jet recording head in which heat is generated by applying a drive signal to a heating element, and this heat is given to ink to generate a bubble and discharge ink through a discharge outlet, wherein said drive signal comprises a first drive signal for storing foaming energy in ink, and a second drive signal for generating a bubble in ink, and said second drive signal of a signal time shorter than the boundary foaming time ts at which foaming energy decreases in case of performing foaming only by said second drive signal, is used, and said first drive signal for compensating a decrease in said foaming energy is applied prior to said second drive signal.

In each of the above methods, when the time at which a bubble is generated by said second drive signal is t=δt, the temperature rise rate at this time is dT(δt), the boundary foaming time at which foaming energy decreases in case of generating a bubble only by said second drive signal without applying said first drive signal is t=ts, and the temperature rise rate at this time is dT(ts), each temperature rise rate may satisfy:

$$dT(\delta t) > dT(ts).$$

Said first drive signal may be for increasing the thickness of an overheated ink layer in ink receiving heat from said heating element.

The surface temperature of said heating element before applying said second drive signal may be heated to the boiling temperature or higher by said first drive signal.

When the time from application start of said second drive signal to bubble generation is t=St, the time at which a bubble is generated by said second drive signal is t=St, the boundary foaming time at which foaming energy decreases in case of generating a bubble only by said second drive signal without applying said first drive signal is t=ts, the boiling point of ink is Tb, the foaming temperature is Tg, and the temperature of ink before applying said first drive signal is Tamb, δt may satisfy:

$$\delta t < \frac{Tg - Tb}{Tg - Tamb} \cdot ts.$$

The ratio J1/J0 of the foaming energy J1 of a bubble formed only by said second drive signal without applying said first drive signal, to the foaming energy J0 of a bubble formed by said first and second drive signals, may satisfy:

$$J1/J0 \times 100 \leq 50\ (\%)$$

The heating quantity of said heating element by said second drive signal may be equal to or more than the heating quantity of said heating element at the boundary foaming time t=ts at which foaming energy decreases in case of generating a bubble only by said second drive signal without applying said first drive signal.

Said ts may be the boundary foaming time when the life of a bubble reduces.

Said ts may be the boundary foaming time when the discharge velocity reduces.

Said first and second drive signals may be a continuous signal.

A resting period may be interposed between said first and second drive signals.

Said first drive signal may comprise a plurality of pulses, and the resting periods between said pulses may gradually become longer.

An ink-jet recording apparatus according to the present invention is an ink-jet recording apparatus to perform recording using an ink-jet recording head that comprises a discharge outlet for discharging ink, an ink flow passage communicating with said discharge outlet, and a heating element for heating ink in said ink flow passage by applying a drive signal to generate a bubble, said head discharging ink through said discharge outlet on the basis of the generation of said bubble;

said apparatus having a first drive signal for storing foaming energy in ink, and a second drive signal for generating a bubble in ink;

said apparatus comprising drive signal supply means for applying, to said heating element, said drive signal in which:

when the time from application start of said second drive signal to bubble generation is t=δt, and the boundary foaming time at which foaming energy decreases in case of generating a bubble only by said second drive signal without applying said first drive signal is t=ts, δt and ts satisfy the relation:

$$\delta t < ts;$$

and, when the applying time of said first drive signal, which is the difference in time from the time at which application of said first drive signal is started, to the time at which said second drive signal is started is t1, the applying time of said second drive signal is (t2- t1), and the heating quantity of said heating element by the drive signal is Q(t), t1, t2, and Q(t) satisfy:

$$\frac{1}{t1}\int_0^{t1} Q(t)\,dt < \frac{1}{\delta t}\int_{t1}^{t2} Q(t)\,dt.$$

Or, it is an ink-jet recording apparatus in which heat is generated by applying a drive signal to a heating element, and this heat is given to ink to generate a bubble and discharge ink through a discharge outlet, said apparatus comprising:

signal supply means for applying said drive signal to said heating element, said drive signal comprising a first drive signal for storing foaming energy in ink, and a second drive signal for generating a bubble in ink, said second drive signal having a signal time shorter than the boundary foaming time ts at which foaming energy decreases in case of performing foaming only by said second drive signal, said first drive signal being applied prior to said second drive signal so as to compensate for a decrease in said foaming energy.

Also in these ink-jet recording apparatuses, each of the above features addable to the above ink-jet recording head driving methods may be added.

DETAILED DESCRIPTION OF THE PREFERRED EMBODIMENTS

Hereinafter, a driving method of an ink-jet recording head and a recording apparatus according to the present invention will be described in detail with reference to the accompanying drawings.

The term "recording" used hereinafter in the present invention means not only to form an image having a specific meaning, such as a character or a figure, on a medium to be recorded, but also to form an image having no specific meaning, such as a pattern, on the medium.

The present invention can be applied to various apparatuses such as printers, copiers, facsimiles with communication systems, printer systems with communication systems and printing parts being combined therein, and word processors with printing parts. Recording is effected on a medium to be recorded, such as paper, yarn, fiber, dishcloth, leather, metal, plastic, glass, wood, or ceramic. The present invention can also be applied to industrial recording apparatuses in combination with various processing apparatuses.

In addition, the term "element substrate" used hereinafter in the present invention indicates not merely a substrate made of a silicon semiconductor but a substrate on which driving circuit elements, wiring, etc., have been formed.

Figure 17:
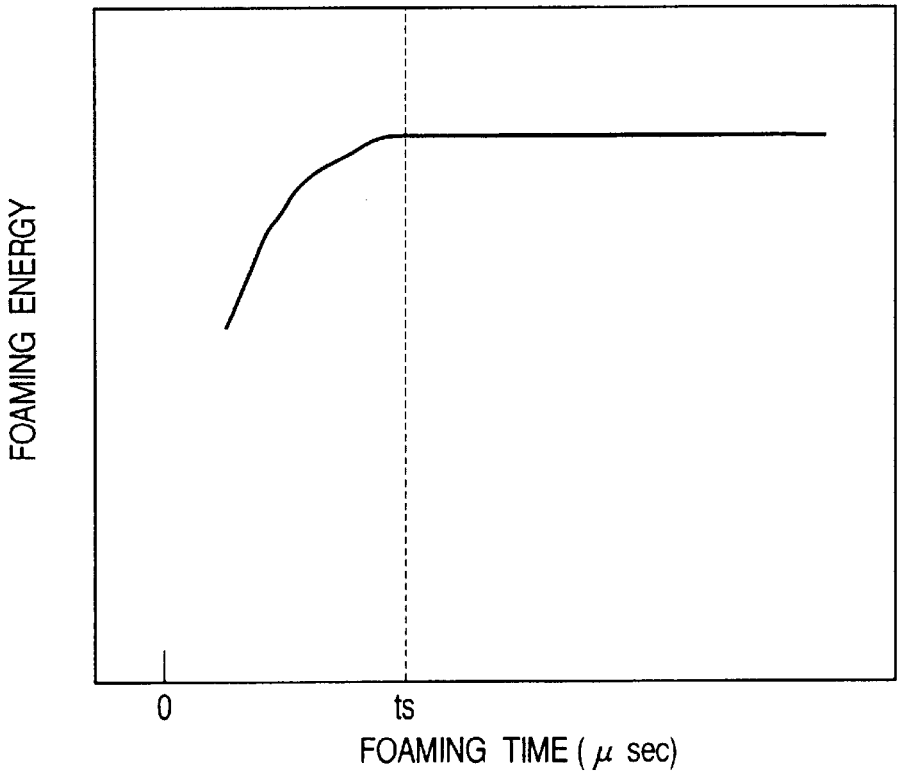
FIG. 17 is a graph showing dependence of the life of a bubble on foaming time according to a single drive signal.

When a bubble is to be generated by rapid overheating in the manner of shortening the pulse width of a driving signal using a single driving signal as in a conventional manner, as shown in the graph of FIG. 17, foaming energy suddenly decreases in the time period of shorter heating time than the boundary foaming time ts in FIG. 17 (foaming time tg after the drive signal is applied until foaming starts is used as the pulse width (heating time) in FIG. 17).

This is believed to be the reason that no sufficient evaporative latent heat for allowing the bubble generated by rapid heating to grow is supplied to the overheated liquid layer. With such a sudden decrease of foaming energy with the boundary being the pulse width tg=ts as described above, discharge velocity decreases likewise (hereinafter, the term "rapid heating" in the description of the present invention means heating in the heating time (tg<ts) in which foaming energy or discharge velocity is suddenly lowered).

A driving method of the present invention aims to ensure sufficient foaming energy even in the region of rapid heating. The method intends to stabilize foaming in the manner that an overheated liquid layer storing evaporative latent heat required for starting homogeneous nucleation is formed by heating according to a first drive signal to ensure a sufficient thickness of the overheated liquid layer, and then rapid heating according to a second drive signal is performed.

The drive signals of the present invention for generating a bubble by supplying heat to ink comprise the first drive signal and the second drive signal. The first drive signal is for forming an overheated liquid layer of a desired thickness by supplying evaporative latent heat to ink, and for complementing foaming energy, which will decrease only by the second drive signal. The second drive signal is for reducing unevenness of foaming start times on a heating element by performing rapid heating. In the present invention, by heating according to the first drive signal, foaming energy in accordance with the thickness of the overheated liquid layer can be controlled independently of the second drive signal, which operates as a trigger for stabilizing foaming.

It is necessary that the temperature of the heating element surface (to be referred to as Tp hereinafter), which is the portion at the highest temperature in ink before rapid heating drive, is increased to the boiling point (to be referred to as Tb hereinafter) or more by heating according to the first drive signal, to form an overheated liquid layer where a foaming nucleus grows. The temperature of the heating element surface should be less than the foaming temperature (to be referred to as Tg hereinafter), at which homogeneous nucleation starts, in order not to foam only by the first drive signal.

The feature of the first drive signal of the present invention will be described below in detail with reference to graphs (FIGS. 1A to 1C) for typically illustrating temperature distribution in ink from the heating element surface before foaming.

Figure 1A:
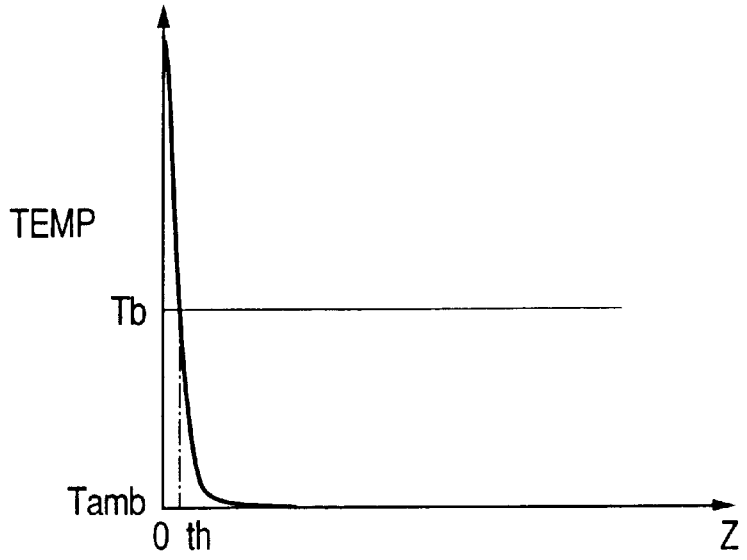
FIGS. 1A, 1B and 1C are graphs for illustrating temperature distribution in ink from a heating element surface in accordance with the difference between a driving method of the present invention and a conventional driving method.
Figure 1B:
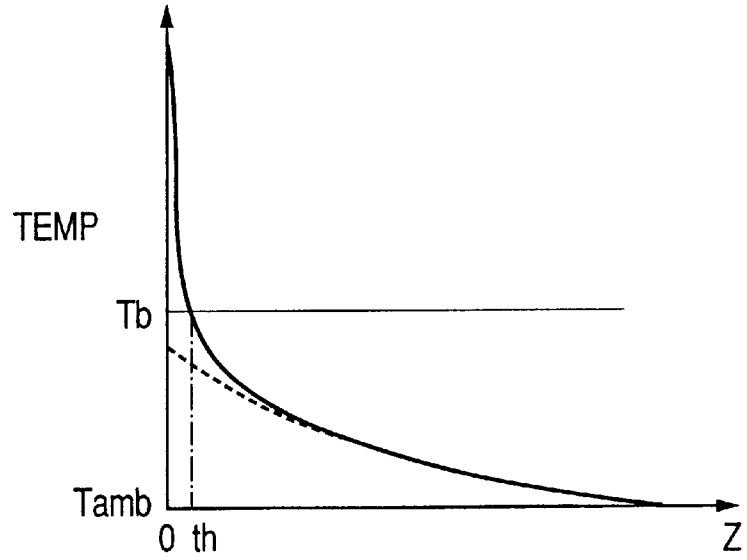
Figure 1C:
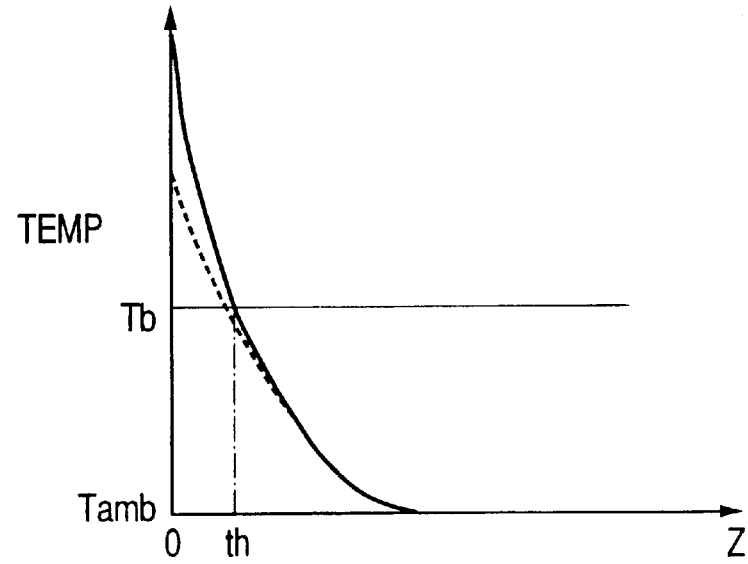

FIG. 1A is a graph for illustrating a conventional driving method by rapid heating, FIG. 1B is a graph for illustrating a new driving method in which conventional preheating is performed to reduce ink viscosity and then rapid heating is performed, and FIG. 1C is a graph for illustrating an optimum driving method according to the present invention.

In each drawing, the ordinate axis represents temperature, and the absissa axis represents distance in ink from the contact surface of a heating element with ink (in case that a protection layer is formed on the surface of the heating resistance element, the surface of the protection layer in contact with ink is considered the heating element surface). The solid line in each drawing shows the temperature distribution in ink immediately before bubble generation. The broken line in each of FIGS. 1B and 1C shows the temperature distribution in ink immediately before heating for foaming (immediately before applying the second signal for foaming). Any foaming nucleus breaks up and cannot grow to a bubble when it is in a state lower than the boiling point. For this reason, any overheated liquid layer that contributes to growth of a foaming nucleus is mainly in an ink region not lower than the boiling point.

In case of rapid heating shown in FIG. 1A, no sufficient heat quantity can flow into ink because of a short applying time of the drive pulse, and the thickness (th) of the overheated liquid layer that contributes to growth of a foaming nucleus becomes thin.

Preheating as shown in FIG. 1B mainly aims to make the growth of a bubble greater by reducing the ink viscosity and, consequently, the ink resistance. For this purpose, the time after preheating starts until heating for discharging ink starts is set to be long, in order to be able to heat a wider region from the heating element to a nozzle. In addition, heating at less than the boiling point is performed in order that a foaming nucleus formed from an impurity or gas in the ink does not grow. Accordingly, since the thickness of the overheated liquid layer is substantially determined by rapid heating, the thickness (th) of the overheated liquid layer becomes slightly thicker but the liquid layer thickness is still thin.

In comparison with these scenarios, in the case of FIG. 1C, in which heating at not less than the boiling point is performed according to the first drive signal, the thickness (th) of the overheated liquid layer can be substantially determined by heating according to the first drive signal, and foaming energy can be controlled independently of the second signal, which operates as a trigger for stabilizing foaming. In addition, by already supplying latent heat for obtaining sufficient foaming energy to ink before applying the second signal, a decrease in foaming energy or discharge velocity at the time of rapid heating can be compensated.

As a matter of course, it is applicable to the driving method of the present invention to perform additionally such a conventional preheating process before applying the first drive signal according to the present invention, in order to improve "initial discharge performance".

For performing rapid heating according to the second drive signal of the present invention, the mean heating quantity of the heating element by the second drive signal is larger than that by the first drive signal (as shown by the below expression (2)).

This makes it possible to avoid foaming by the first drive signal and to perform rapid heating surely by the second drive signal. Here, let it be supposed that the applying time of the first drive signal until the second drive signal is started is tl, the applying time of the second drive signal is (t2- t1), and the heating quantity of the heating element by each drive signal is Q(t).

$$\frac{1}{tl}\int_0^{tl} Q(t)\,dt < \frac{1}{\delta t}\int_{tl}^{t2} Q(t)\,dt \tag{2}$$

Even in the case of obtaining sufficient foaming energy, because the heating element surface has been heated in advance according to the first drive signal, and a sufficient overheated liquid layer has been formed in ink, the foaming time δt after the application of the second drive signal starts until foaming starts can be less than ts, in contrast with the time ts explained with reference to FIG. 17 in which rapid heating is started according to a single drive signal.

By making the temperature rise rate in the foaming time δt of the second drive signal equal to or more than the temperature rise rate at the foaming time when rapid heating according to the conventional single drive signal is started, unevenness of foaming times in rapid heating can be suppressed.

This makes the mean heating quantity of the heating element by the second drive signal not less than that at t=ts by the single drive signal. In the case of not applying the first drive signal, the surface temperature of the heating element at the time of applying the second drive signal is the initial temperature of ink (to be referred to as Tamb hereinafter).

Under the condition that the heating quantity by the second drive signal according to the present invention is equal to the heating quantity of rapid heating according to the conventional single drive signal, from the expression

(15) in an A. Asai's thesis (A. Asai, "Application of the Nucleation Theory to the Design of Bubble Jet Printers", J.J.A.P., Vol. 28, No. 5, p. 909, 1989), the ratio of δt to ts can be considered the ratio of (Tg–Tp) to (Tg–Tamb) approximately. Further, when Tp is replaced by Tb from the condition that the surface temperature of the heating element by the first drive signal is not less than the boiling point, δt must satisfy at least the following expression:

$$\delta t < \frac{Tg - Tb}{Tg - Tamb} \cdot ts. \quad (3)$$

In order to stabilize foaming, the applying time of the drive pulse of the second drive signal is preferably as short as possible. This is in the direction that the contribution of the second drive signal to foaming energy becomes relatively less than that of the first drive signal. In this case, the contribution of the first drive signal to foaming energy becomes greater, so control of foaming energy is practically done with the first drive signal.

For controlling foaming energy with the first drive signal, at least, the ratio of the foaming energy of a bubble formed only by the second drive signal without applying the first drive signal, to the foaming energy of a bubble formed by the first and second drive signals is desirably 50% or less. That is, a drive condition is desirable in which the contribution of the first drive signal to foaming energy becomes greater than 50%.

By reducing the additional effect of rapid heating on foaming energy, deterioration of discharge performance, which has been a problem in rapid heating, and instability of discharge velocity or quantity due to unevenness in thickness of overheated liquid layers, can be reduced. The contribution of the first drive signal to foaming energy is preferably as great as possible. When it is greater than 50%, the decrease of foaming energy due to rapid heating can be suppressed to be at least one-half. The kinetic energy of a droplet is in proportion to foaming energy and to the square of discharge velocity. So, if the decrease of foaming energy can be suppressed to be at least one-half, the decrease of discharge velocity can be 30% at most.

More preferably, the contribution of the first drive signal to foaming energy is more than 70%. This makes it possible to suppress the decrease of discharge velocity due to the decrease of foaming energy to be 20% or less.

The driving method of an ink-jet recording head according to the present invention will be described below more specifically. An example of the construction of an ink-jet recording head or a recording apparatus in which the driving method according to the present invention is performed will be described first.

Figure 2:
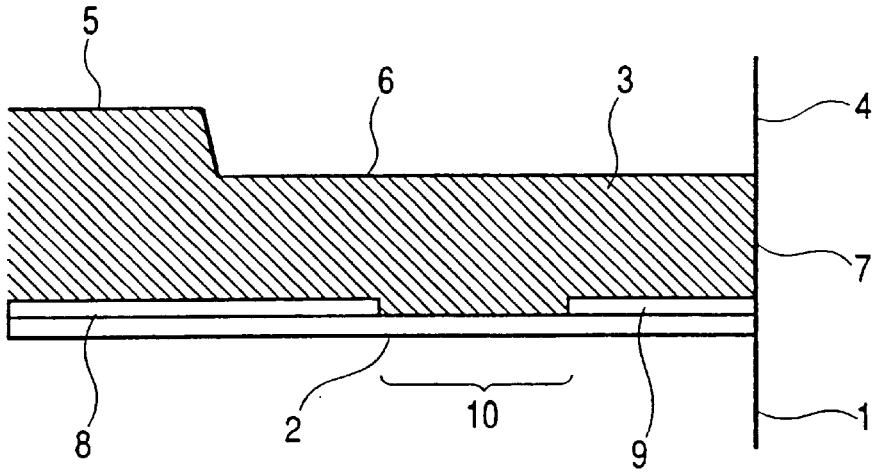
FIG. 2 is a sectional view of a principal part of a recording head.

FIG. 2 shows a sectional view of the construction of an ink flow passage of an ink-jet recording head. A thin film resistance element layer 2 is provided on a substrate 1 made of silicon or the like. A top plate 4 with grooves, in which a partition (not shown), a recessed portion for forming a common liquid chamber, and a plurality of grooves for forming a plurality of ink flow passages are formed, is joined to the substrate to form a common liquid chamber 5, ink flow passages 6, and discharge outlets 7.

By applying a drive signal through a selection electrode 8 and a common electrode 9 connected to the thin film resistance element layer 2, the portion 10 (heating element; heater) of the thin film resistance element layer 2 between the selection and common electrodes 8 and 9 generates heat. By generating a bubble in ink 3 by this heat, the ink 3 is discharged through the discharge outlet 7. In this example, Pt is used as the material of the thin film resistance element layer and Au is used as the material of each of the selection and common electrodes. Pt is chemically stable and greatly changes in its resistance according to temperature. So, by using this, the temperature of the heating element can be directly measured by measuring the resistance of the heating element. The size of the heating element is 100 μm ×200 μm. The substrate used comprises a silicon substrate on which a thermal oxide film of the thickness of 2.7 μm has been formed. A glass top plate with grooves for forming the ink flow passages and discharge outlets is joined to the substrate to form a recording head.

The pulse width of a conventional drive signal is 2 to 10 μsec. In rapid heating, however, because foaming is performed using a pulse of a shorter applying time, it is important to make thermal flux from the heating element act on ink efficiently and rapidly.

As an example of a recording head highly responsive to such a drive signal, there is a recording head described in Japanese Patent Application Laid-open No. 55-126462 (1980), in which no protection layer is provided on a heating element and the heating portion of the heating element is in direct contact with ink. As the material of a thin film resistance element used in such a recording head, an alloy containing an element such as Ta, Ir, Ru, or Pt as one of its principal component elements is preferable. More preferable is an alloy containing at least one of those elements and at least one of Al, Ti, V, Cr, Ga, Zr, Nb, Hf, and Ta. For increasing the resistance value of the thin film resistance element, C, N, O, Si, or the like, may be added into the above alloy. Of course, a protection film may be used within the scope that thermal flux can be made to act on ink efficiently and rapidly.

In this example, the ingredients of ink used are as follows:

black dye 3.0 wt%;

diethylene glycol 15.0 wt.%;

N-methyl-2-pyrolidone 5.0 wt.%;

ion exchange water 77.0 wt.%.

The foaming temperature Tg of this aqueous ink is about 300° C.

Figure 3:
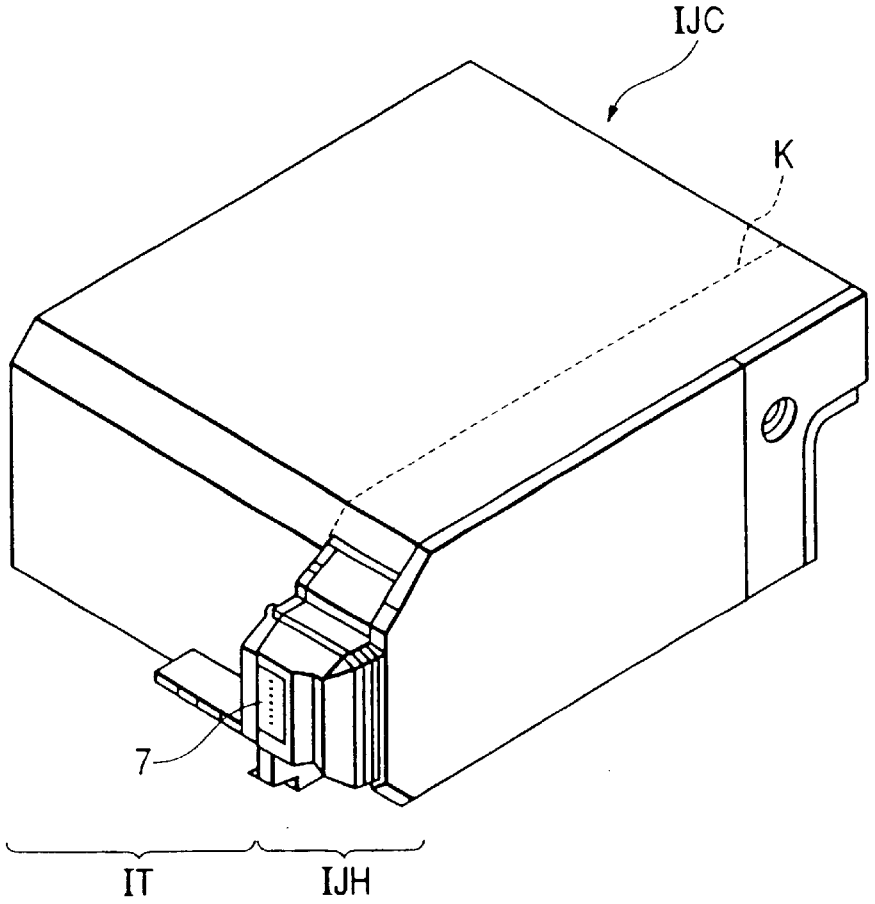
FIG. 3 is a perspective view showing the construction of an ink-jet head cartridge.

FIG. 3 is a schematic perspective view showing the construction of an ink-jet head cartridge IJC in which an ink-jet recording head and an ink tank for holding ink to be fed to the ink-jet recording head are so joined as to be separable. In the ink cartridge IJC, the ink tank IT and the ink-jet recording head IJH are separable at the position of the boundary K as shown in FIG. 3. The ink cartridge IJC is provided with electrodes (not shown) for receiving an electric signal supplied from the carriage side when it is mounted on a carriage. According to this electric signal, the heating element of the recording head IJH is driven as described above.

In FIG. 3, the reference numeral 7 denotes an ink discharge outlet. A plurality of ink discharge outlets 7 are arranged. A fibrous or porous ink absorber is provided in the ink tank IT for holding ink. Ink is held by the ink absorber.

Figure 4:
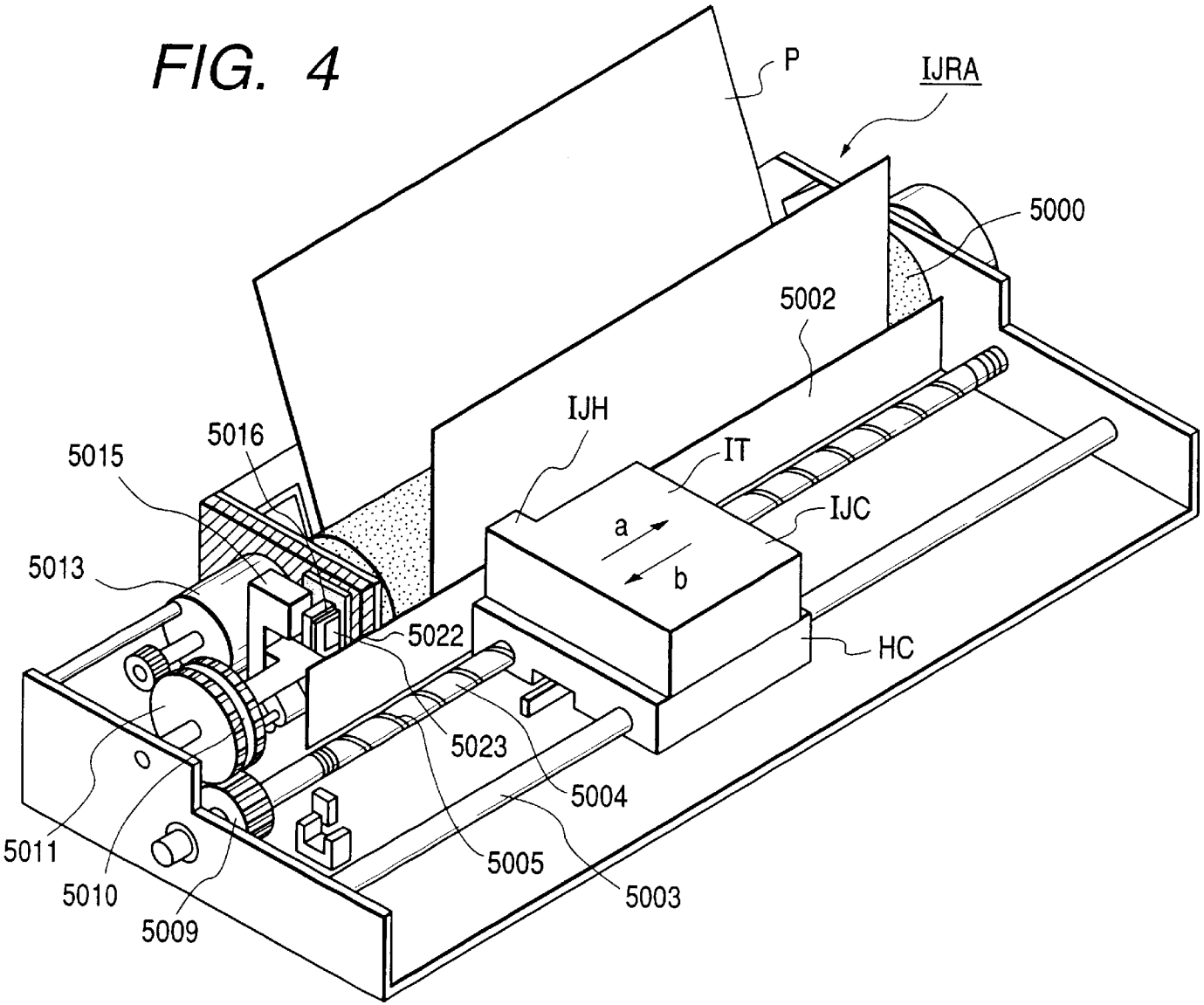
FIG. 4 is a perspective view for illustrating the construction of an ink-jet recording apparatus.

FIG. 4 is a schematic perspective view for illustrating the construction of an ink-jet recording apparatus, IJRA in which a driving method according to the present invention is performed. In FIG. 4, a lead screw 5004 is rotated in accordance with rotation or reverse rotation of a drive motor 5013 through driving- force transmission gears 5009 to 5011. A carriage HC has a pin (not shown) engaging with a spiral groove 5005 of the lead screw 5004, and is moved forward and backward in the directions a and b while being supported by a guide rail 5003. The above-described ink head cartridge IJC is mounted on the carriage HC. The reference numeral 5002 denotes a paper pressing plate for pressing a recording paper P, which is a medium to be recorded, onto a platen 5000 along the moving direction of the carriage HC.

The reference numeral 5016 denotes a member for supporting a cap member 5022 for capping the front surface of the recording head IJH. The reference numeral 5015 denotes an aspirator for performing aspiration in the cap, which performs aspiration recovery of the recording head through an opening 5023 in the cap.

In this recording apparatus, drive signal supply means is provided for supplying a drive signal for heating a heating element of the ink-jet recording head.

Figure 5:
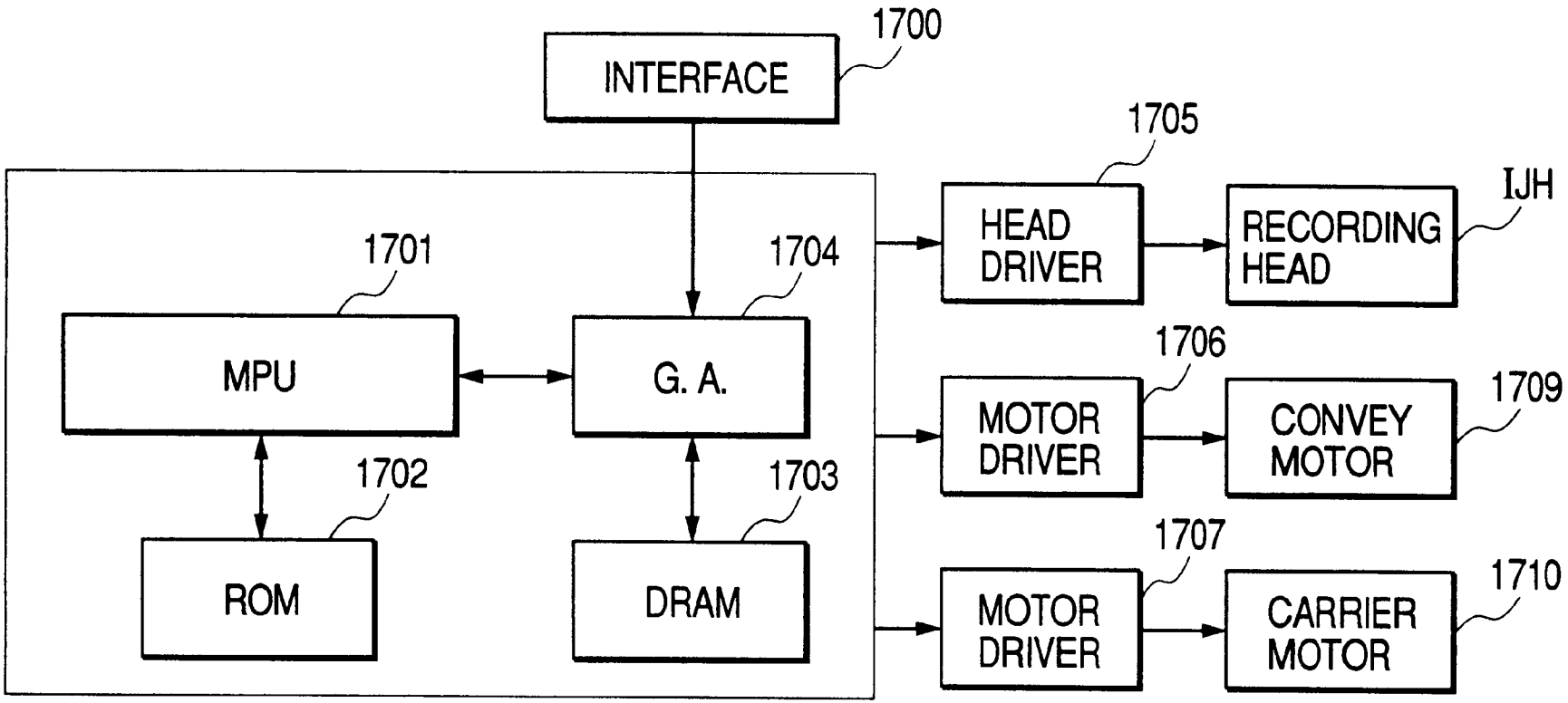
FIG. 5 is a block diagram showing the construction of a control circuit of the ink-jet recording apparatus.

FIG. 5 is a block diagram showing the construction of a control circuit of the above ink-jet recording apparatus. The reference numeral 1700 denotes an interface. The reference numeral 1701 denotes an MPU. The reference numeral 1702 denotes a ROM for storing a control program to be executed by the MPU 1701. The reference numeral 1703 denotes a DRAM for storing various data (such as the above-described recording signals, and recording data supplied to the recording head IJH). The reference numeral 1704 denotes a gate array (G.A.) for performing supply control of recording data to the recording head IJH, and also performing data transference control between the interface 1700, MPU 1701, and RAM 1703.

The reference numeral 1710 denotes a carrier motor for conveying the recording head IJH. The reference numeral 1709 denotes a conveying motor for conveying a medium to be recorded. The reference numeral 1705 denotes a head driver for driving the recording head IJH. The reference numerals 1706 and 1707 denote motor drivers for driving the conveying motor 1709 and the carrier motor 1710, respectively.

Operations of the above control construction will be described. When a recording signal is input to the interface 1700, the recording signal is converted into recording data for performing recording, between the gate array 1704 and the MPU 1701. The motor drivers 1706 and 1707 are driven, and the recording head IJH is driven with the drive signal in accordance with the recording data sent to the head driver 1705, to perform recording.

Next, the driving method according to the present invention that is performed with the construction of the above ink-jet recording head, etc., will be described in more detail with reference to FIGS. 6 to 9.

Figure 6:
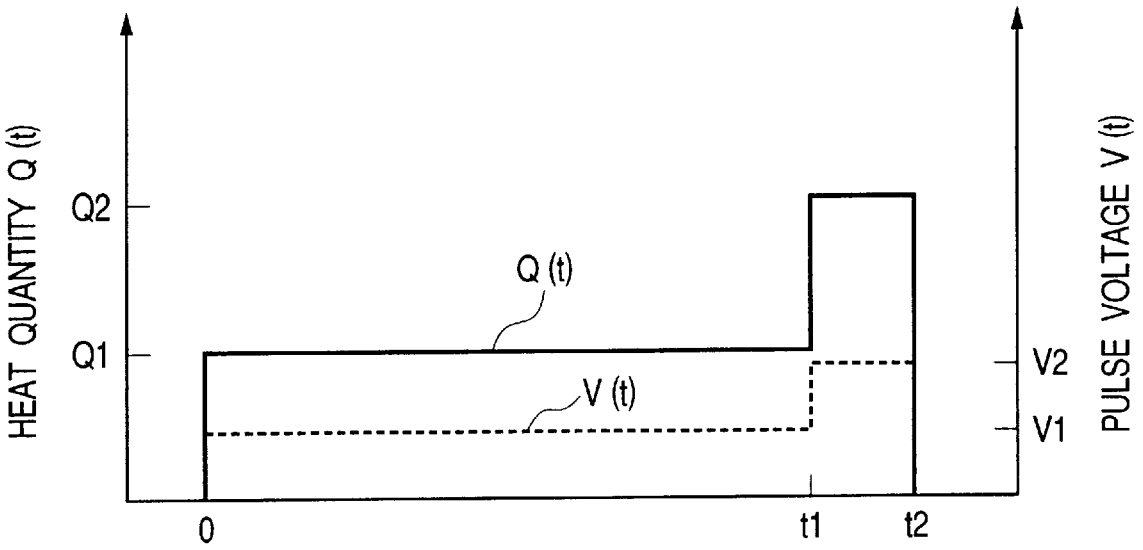
FIG. 6 is a chart showing the first example of drive signal waveform of a driving method according to the present invention.

FIG. 6 shows the pulse voltage values (pulse waveform) of the first and second drive signals, and the heat quantity of the heating element. The drive signal waveform of FIG. 6 satisfies the relation of the above-described expression (2). A drive signal of a pulse voltage V1 that causes the heat quantity of the heating element to be Q1 in the time period from t=0 to t=t1 is applied to the heating element as the first drive signal, and a drive signal of a pulse voltage V2 that causes the heat quantity of the heating element to be Q2 in the time period from t=t1 to t=t2 is applied to the heating element as the second drive signal. As a comparative example, a drive signal of a single rectangular pulse of the pulse voltage V3 (see FIG. 7) is used that causes the heat quantity of the heating element to be Q3 in the time period from t=0 to t=t3.

From Rayleigh's theory (Philos. Mag. 34. pp. 94-98, 1917), since the maximum radius of a bubble is in proportion to the time $\tau$ until the bubble breaks, and foaming energy is substantially in proportion to the foaming volume of the bubble, foaming energy can be considered to be in proportion to the cube of the bubble life $\tau$.

By applying a drive signal to a heating element and measuring the lives $\tau$ of generated bubbles and the time dispersion $\Delta\tau$ in the lives, the magnitude and stability of foaming energy can be relatively evaluated. Foaming energy will be described below with regard to $\tau$ and $\Delta\tau$.

Figure 7:
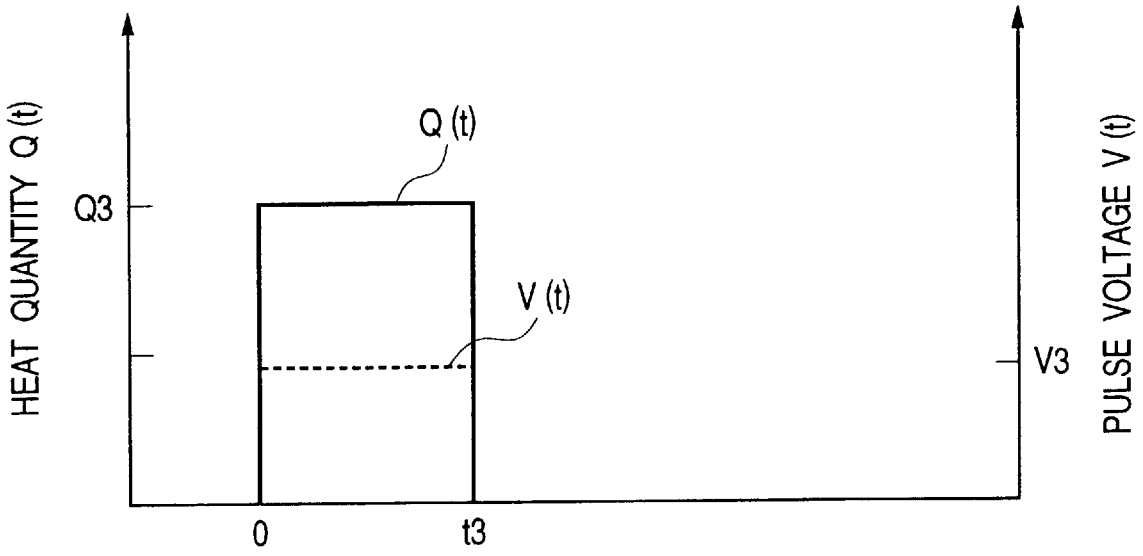
FIG. 7 is a chart showing a single drive signal waveform.
Figure 8:
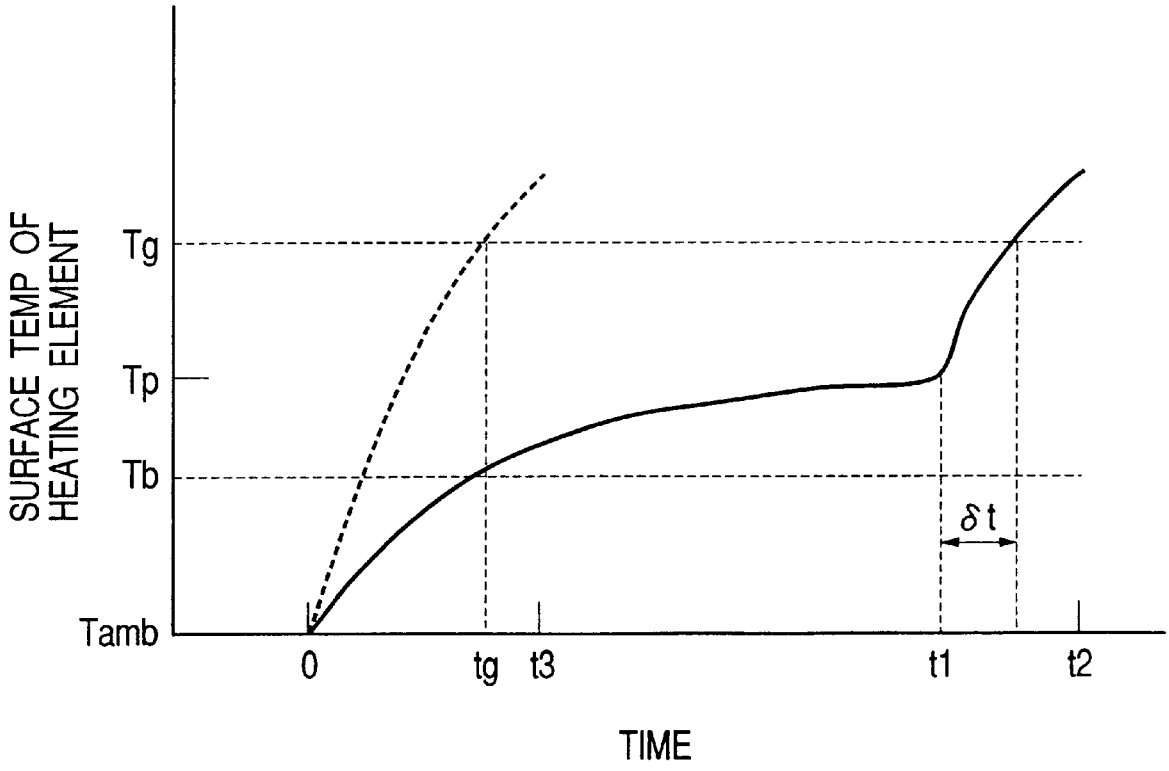
FIG. 8 is a graph showing a change with time in surface temperature of a heating element obtained from a change in resistance of the heating element when a drive signal according to the present invention is applied.
Figure 9:
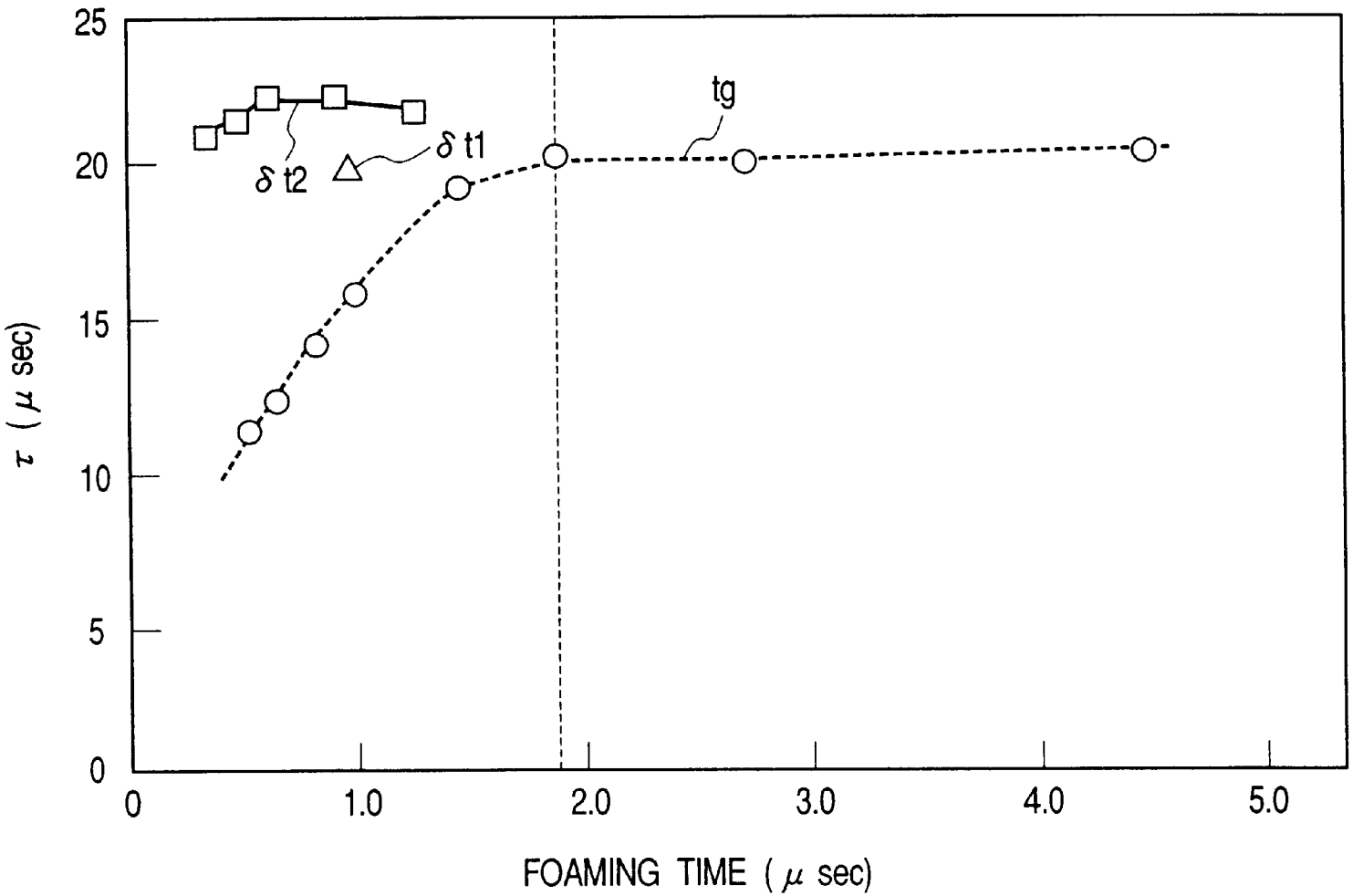
FIG. 9 is a graph showing dependence of the life τ of a bubble on foaming time when a drive signal according to the present invention is applied.

FIG. 8 is a graph showing a change with time in surface temperature of a heating element obtained from a change in resistance of the heating element when each of the drive signals shown in FIGS. 6 and 7 is applied (wherein the change with time by the drive signal of FIG. 6 is shown by a solid line, and the change with time by the drive signal of FIG. 7 is shown by a broken line). FIG. 9 is a graph showing dependence of the life $\tau$ of a bubble on foaming time. In FIG. 8, Tamb, Tb, Tp, and Tg represent the initial temperature of ink, the boiling temperature, the final surface temperature of the heating element by the first drive signal, and the foaming temperature, respectively.

As the foaming time of FIG. 9, the foaming time $\delta t$, which is the time after application of the second drive signal starts until foaming starts, is used in the case of the driving method according to the drive signal of FIG. 6, and the foaming time tg, which is the time after the driving signal is applied until foaming starts, is used in case of the driving method according to the drive signal of FIG. 7. As shown in FIG. 8, in the driving method of the present invention using the signal of FIG. 6, the curve of the surface temperature of the heating element becomes convex downward near t=t1, and suddenly rises after t=t1.

First, ts (boundary foaming time) is obtained from the drive using the drive signal of FIG. 7. The pulse voltage V3 of the driving method using the drive signal of FIG. 7 has been set to be 1.1 times (k value) the minimum voltage that a bubble is generated with the pulse width t3. The initial temperature of ink is 23° C. In the single rectangular pulse drive of FIG. 7, $\tau$ is in a state of long life and ensures sufficient foaming energy in tg>1.8 $\mu$sec, but it suddenly falls in tg<1.8 $\mu$sec (see FIG. 9). From this result, ts of ink used was determined to be 1.8 $\mu$sec. In this case, the heat quantity Q3 of the heating element was 550 $MW/m^2$, and the temperature rise rate at the foaming time tg=ts was $6\times10^7$C/sec.

In this example, ts of ink used was obtained by considering it to be the boundary time at which foaming energy suddenly falls. But, since a change in ink velocity corresponds to a change in foaming energy, ts may be obtained from such a change in the discharge velocity of ink.

Figure 10:
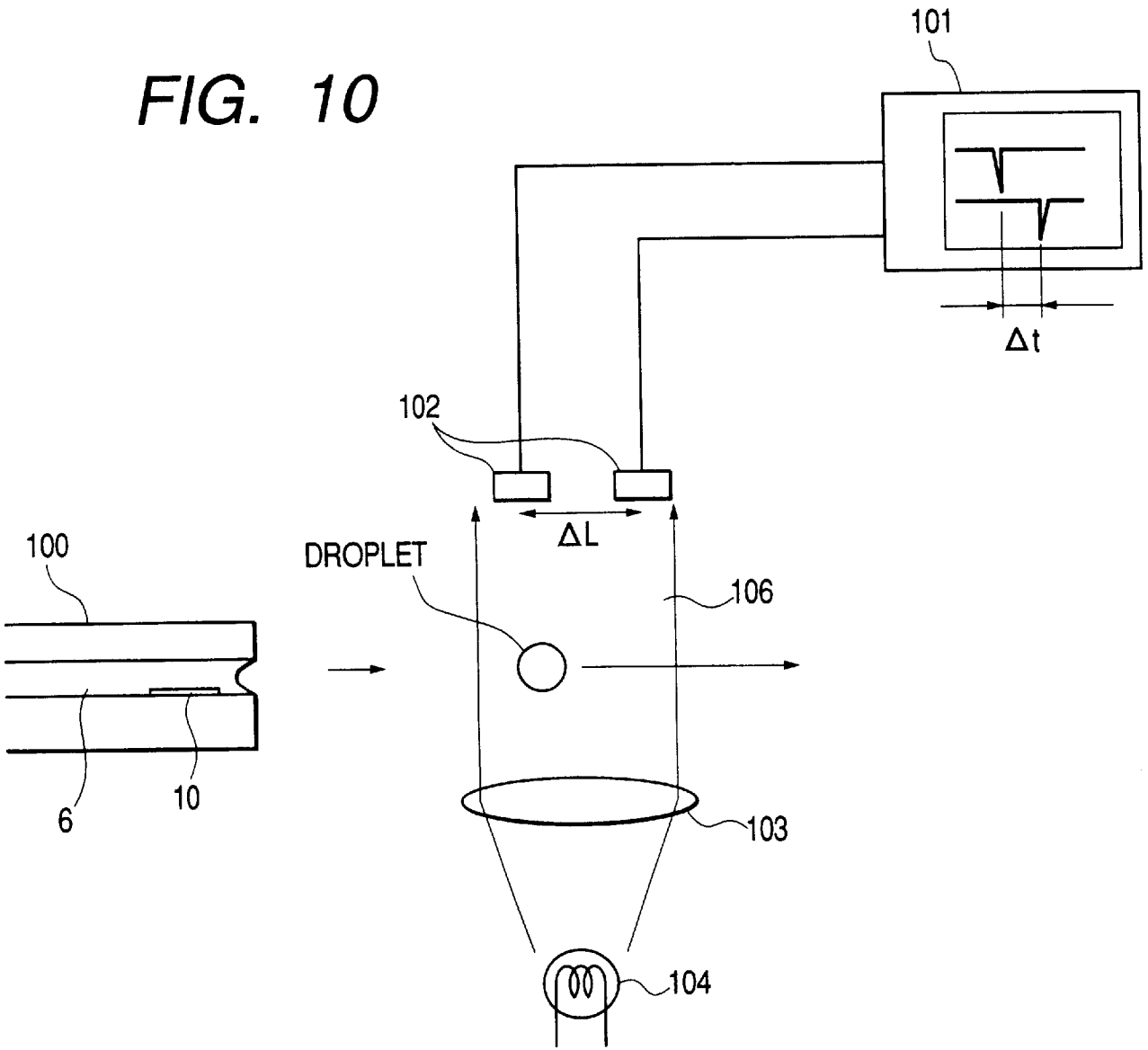
FIG. 10 is a schematic view for illustrating a measuring system to measure the discharge velocity of a droplet.

FIG. 10 is a representation for illustrating a schematic construction to measure the discharge velocity of ink. Parallel rays 106 are applied from a lamp 104 through a lens 103 perpendicularly to the trajectory of a droplet discharged from an ink-jet recording head 100. Two photodiodes 102 are disposed at a certain interval $\Delta L$ at the position opposite to the lens so as to be irradiated with the parallel rays. Interruption of the light incident on the photodiodes 102 by a droplet is detected as a signal with an oscilloscope 101 or the like, and the time interval $\Delta t$ of the signals appearing on the two photodiodes is measured. The velocity of the droplet (discharge velocity) can be obtained from the time interval At and the above-described interval $\Delta L$. In FIG. 10, the reference numeral 6 denotes an ink flow passage, and the reference numeral 10 denotes a heating element.

In this case, by changing the pulse width of the drive signal applied to the heating element 10 of the ink-jet recording head, the point at which the discharge velocity starts to decrease suddenly can be found to obtain ts.

When it is considered to satisfy the above-described expression (3), δt more desirably meets the condition of δt<1.3 μsec. By temperature measurement, the surface temperature of the heating element at t=t3 was 360 to 370° C. The life of tg=1 μsec was 15.6 μsec. A thousand lives for 10 seconds at the drive frequency of 100 Hz in this case were measured to examine the ratio ($\Delta\tau/|\tau|$) of the life time dispersion Δτ to the mean life |τ|. As the result, $\Delta\tau/|\tau|$ at tg=1 μsec was half or less of $\Delta\tau/|\tau|$ at tg=1.8 μsec. In the single rectangular pulse drive, it was found that unevenness of foaming start times decreased but foaming energy also decreased when the pulse width was shortened.

EXAMPLE 1

In the driving method using the drive signal of the waveform of FIG. 6, in the first drive signal, t1=10 μsec, and the drive voltage V1 and Q1 were set such that the surface temperature Tp of the heating element at t=t1 was about 150° C, which is higher than the boiling temperature. The initial temperature of ink was 23° C. The drive voltage V2 was set to be 1.1 times (k value) the minimum voltage that a bubble was generated in the pulse width t2. The foaming time δt1, at which the temperature rise rate was about $6\times10^{7}$° C/sec, was 1.2 to 1.3 μsec. The lives of bubbles measured when δt1=1 μsec were 20 μsec (see FIG. 9), and the life time dispersion of this time was less than tg=ts when the signal waveform of FIG. 7 was used. δt1 satisfied the expression (3) (δt<1.3 μsec). By using the driving method of the present invention, foaming energy could be made to be substantially equal to that when tg=ts of the single rectangular signal, and the life time dispersion could be made less.

The ratio of foaming energy when tg=1 μsec formed only by the second drive signal without applying the first drive signal to foaming energy when δt1=1 μsec can be calculated with the cubes of the bubble lives in each case. The contribution of the second drive signal to foaming energy was 47%, and it was found that substantially half or more of the foaming energy could be controlled by the first drive signal.

COMPARATIVE EXAMPLE 1

Under the condition of this first drive signal, when the heat quantity Q2 of the second drive signal was 0.9×Q3, no bubble was generated when δt2<1.3 μsec, and the dispersion of bubble lives could not be reduced.

EXAMPLE 2

In the driving method using the drive signal of the waveform of FIG. 6, in the first drive signal, t1=5 μsec, and V1 and Q1 were set such that the surface temperature Tp of the heating element at t=t1 was about 180° C, which is higher than the boiling temperature. The drive voltage V2 was set to be 1.25 times (k value) the minimum voltage that a bubble is generated in the pulse width t2. FIG. 9 shows foaming times δt2 and bubble lives when the drive voltage V2 of the second drive signal was changed. The initial temperature of ink was 23° C in each case. The foaming time δt2, at which the temperature rise rate was about $6\times10^{7}$° C/sec, was about 1.2 usec. The heat quantity Q2 at this time was 700 $MW/m^2$. From this, rapid heating was performed when δt2<1.2 μsec.

From FIG. 9, bubble lives in the region of δt2<1.1 μsec were sufficiently great in comparison with bubble lives in the region of tg<1.1 μsec in the case of the driving method of FIG. 7. When the ratio of foaming energy formed only by the second drive signal without applying the first drive signal to foaming energy by the first and second drive signals was calculated with the cubes of the bubble lives in each case, the contribution of the second drive signal to foaming energy was 45% or less in the region of foaming time not more than 1.1 μsec. From this, it was found that substantially half or more of the foaming energy could be controlled by the first drive signal. The bubble life was longer even in comparison with that in the single rectangular pulse drive of tg=1.8 μsec, and so it was found that sufficient foaming energy can be ensured by the driving method of the present invention.

Besides, the life time dispersion Δδ when δt2=1.1 μsec was less than that when tg=1.8 μsec of FIG. 3.

COMPARATIVE EXAMPLE 2

Under the condition of the first drive signal of the example 1, when the heat quantity Q2 of the second drive signal was Q2<Q3, no bubble was generated when δt2<1.8 μsec, and the dispersion of bubble lives could not be reduced.

In the driving method of the present invention as described above, an overheated liquid layer storing evaporative latent heat required for starting homogeneous nucleation is formed by heating according to the first drive signal to ensure a sufficient thickness of the overheated liquid layer, and then rapid heating according to the second drive signal is performed. This makes it possible to increase foaming energy while ensuring foaming stability.

OTHER MODES

In the expression (3), when the initial temperature of ink is the normal temperature (20 to 35° C) or more, the left side of the expression becomes great, and the condition for δt becomes loose. An ink liquid at the normal temperature contains water, an organic solvent, and a coloring agent, whose contents are preferably in the ranges of 50,to 99 wt.%, 1 to 30 wt.%, and 0.2 to 20 wt.%, respectively. In the case of using an ink containing the ingredients in such ranges, the conditions of the driving method can be obtained by entering the boiling point and the foaming temperature of each ingredient into the expression (3), like the above examples of FIGS. 6 to 9.

The above examples were described using a recording head in which each heating resistance layer forming a heating element is in direct contact with ink. For such a recording head, however, also usable is a heating element comprising a conventional thin film resistance element layer, a protection layer made of an insulating substance, and an anti-cavitation layer tolerable to cavitation erosion, corrosion, repetitive heating, oxidation, etc., due to electrochemical reaction by ink in contact therewith.

In such a case, the thickness of the protection layer and anti-cavitation layer is preferably so thin that the response to the drive signal is high and the heat generated from the heating element acts on ink efficiently and rapidly. As the anti-cavitation layer, conventionally used is a metal or alloy such as Ta, Ta-Al, or Ir. As the protection layer, conventionally used is an insulating thin film poor in heat conductivity such as $SiO_2$, SiN, Ta-O, or Ta-Al-O. The protection layer is preferably thin for improving the efficiency of heat conduction to the heating element. In case of using an aqueous ink, it is necessary that the foaming time δt is less than 1.3 μsec, as described with FIGS. 6 to 9. In the point of stabilizing foaming, the shorter the foaming time bt is, the better it is. Preferably, it is 1 μsec or less.

The first drive signal of the signal waveform shown in FIG. 6 is at a constant voltage lower than the second drive signal. But, as the first drive signal, usable are various drive signal waveforms such as a single drive pulse, a plurality of pulses, and a stepwise pulse. FIGS. 11 to 14 show some examples of drive signal waveforms in the driving method according to the present invention.

Figure 11:
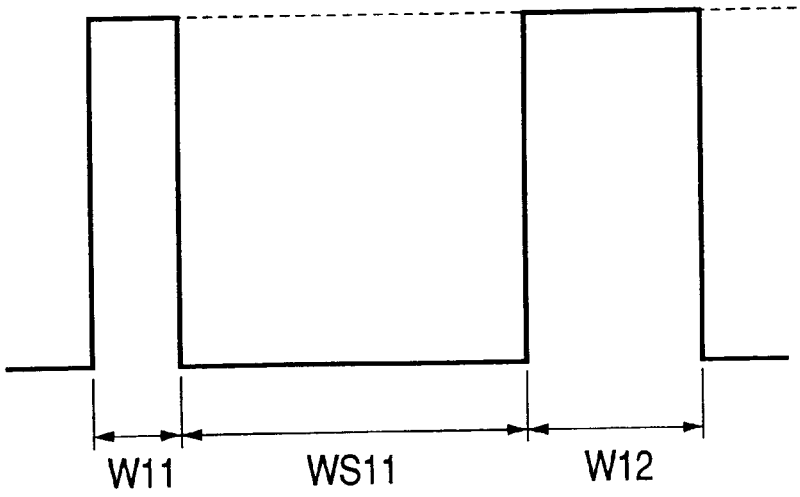
FIG. 11 is a chart showing the second example of drive signal waveform of the driving method according to the present invention.
Figure 12:
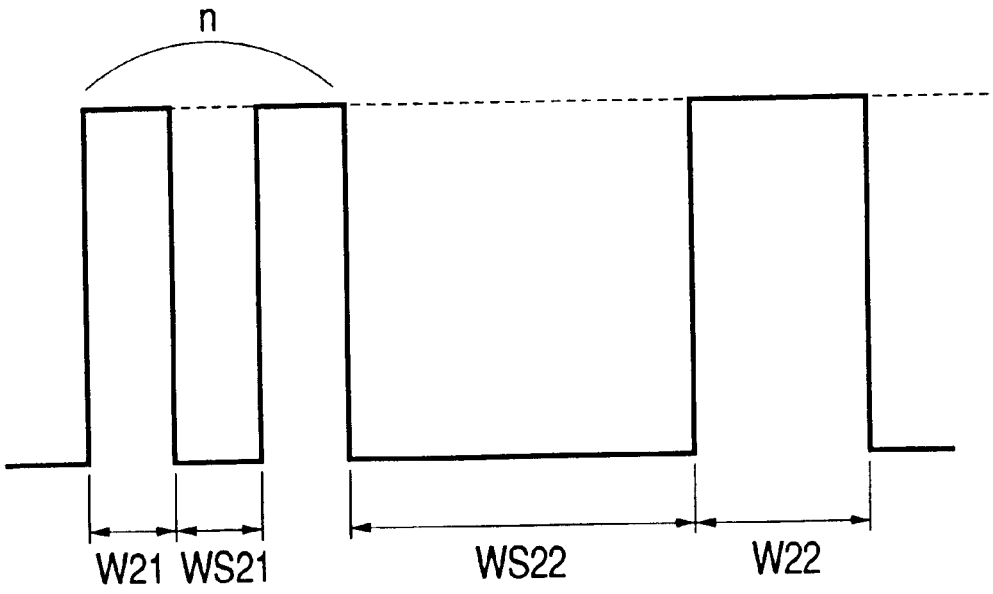
FIG. 12 is a chart showing the third example of drive signal waveform of the driving method according to the present invention.
Figure 13:
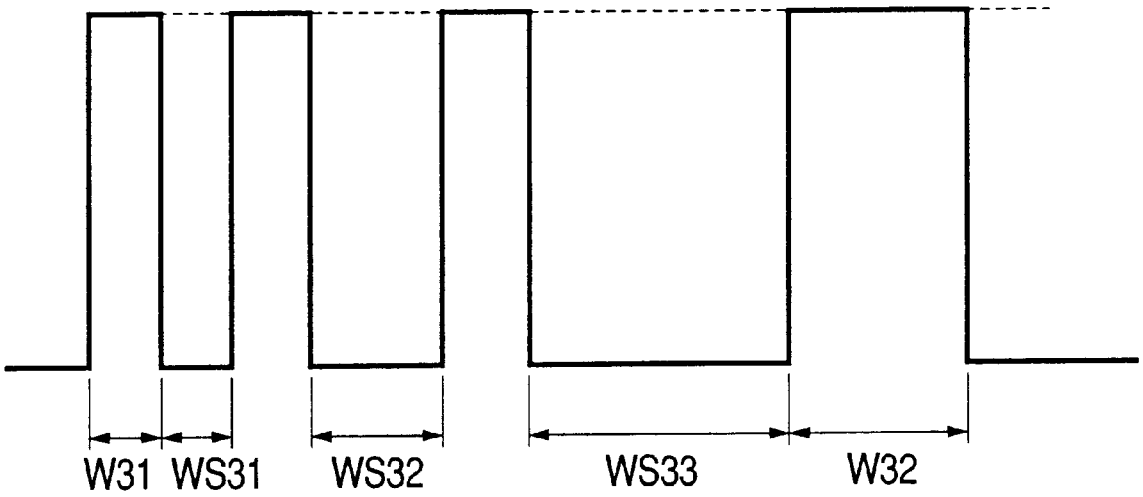
FIG. 13 is a chart showing the fourth example of drive signal waveform of the driving method according to the present invention.
Figure 14:
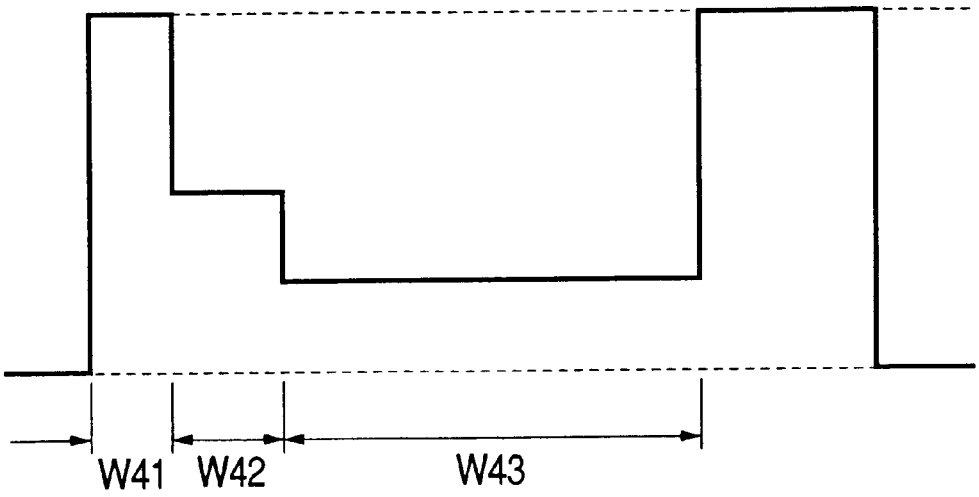
FIG. 14 is a chart showing the fifth example of drive signal waveform of the driving method according to the present invention.

FIG. 11 shows a drive signal waveform according to the present invention, in which the waveform comprises the first and second drive signals having the same drive voltage, and the first drive signal is made up of a rectangular pulse of a pulse width W11 and a resting period WS11. W12 is the pulse width of the second drive signal. FIG. 12 shows a drive signal waveform according to the present invention, in which the first and second drive signals have the same drive voltage, and the first drive pulse is made up in the manner that a pulse of a pulse width W21 is periodically applied n times (only two are shown in the drawing) at intervals of a resting period WS21, and a resting period WS22 is provided after the last pulse applied. W22 is the pulse width of the second drive signal. By the drive signal waveform of FIG. 12, the thickness of the overheated liquid layer can be increased in accordance with the number of pulses. FIG. 13 shows a drive waveform showing an example in which the plurality of pulses of the first drive signal of FIG. 12 are applied at gradually widening intervals. The first and second drive signals have the same drive voltage. Each rectangular pulse of the first drive signal has a pulse width W31 equal to that of FIG. 12, and the pulse intervals become wider gradually as WS31, WS32, and so on. W32 is the pulse width of the second drive signal. After raising the surface temperature of the heating element, by using the long resting period WS32, the thickness of the overheated liquid layer in ink can be increased while keeping the surface temperature of the heating element low. FIG. 14 shows a driving method in which the first drive signal decreases stepwise at pulse widths of W41, W42 and W43, the drive signal waveforms of FIGS. 6 and 11 are combined, and, like FIG. 13, after rapidly raising the surface temperature of the heating element, heating is performed at a low voltage in order that the thickness of the overheated liquid layer can be increased at the low voltage.

The driving method of ink-jet recording of the present invention is effective even in a bubble communication discharge method. The bubble communication discharge method described here is an ink-jet recording method in which a bubble due to film boiling generated by heating ink for discharge is made to communicate with the outside air near the discharge outlet when the internal pressure of the bubble is negative, or the like, and thereby ink is discharged. It is described in Japanese Patent Application Laid-Open Nos. 2-112832, 2-112833, 2-112834, 2-114472, etc.

According to this bubble communication discharge method, since the gas forming the bubble is not emitted with a discharged ink droplet, generation of a splash, a mist, or the like, can be reduced, and soiling of a medium to be recorded and soiling of the apparatus can be prevented. Besides, as a basic action in the bubble communication discharge method, the ink on the discharge outlet side of the portion where a bubble is generated is all discharged as ink droplets in principle. For this reason, the quantity of discharged ink can be defined in accordance with the structure of the recording head, e.g., the distance from the discharge outlet to the above bubble generation portion. As a result, by the above bubble communication discharge method, it becomes possible to perform discharge stable in discharge quantity without being so much affected by a change in ink temperature, or the like.

Figure 15A:
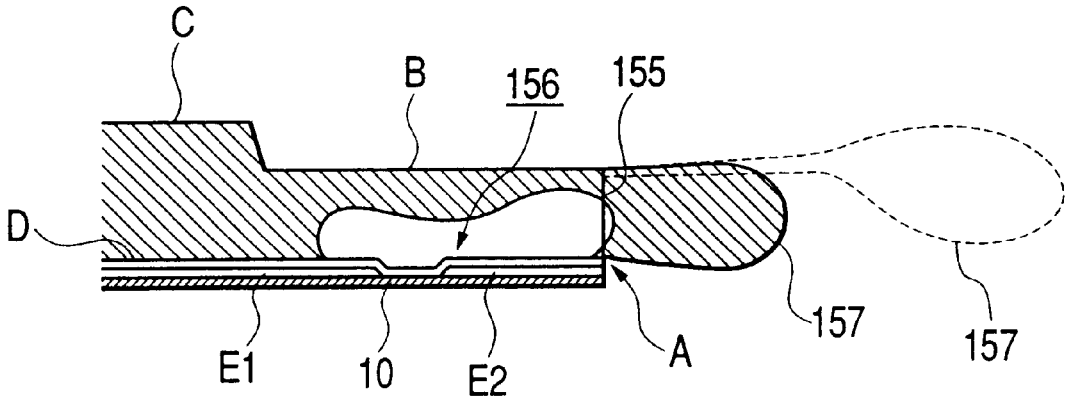
FIGS. 15A and 15B are sectional views of principal parts of recording heads for illustrating the recording heads and their discharge methods, each of which can be applied to the present invention.
Figure 15B:
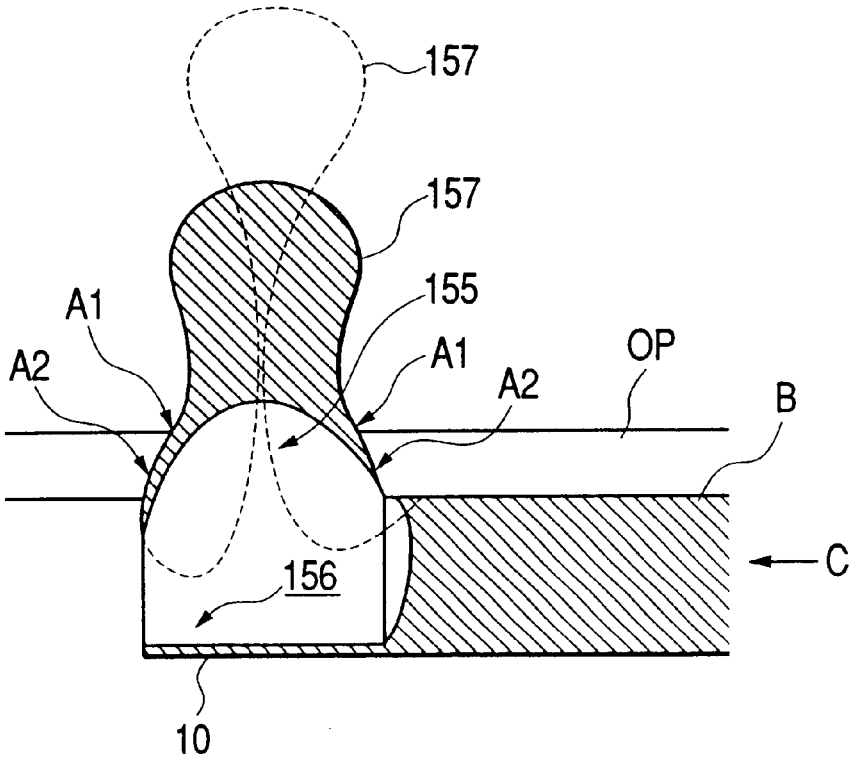
Figure 16:
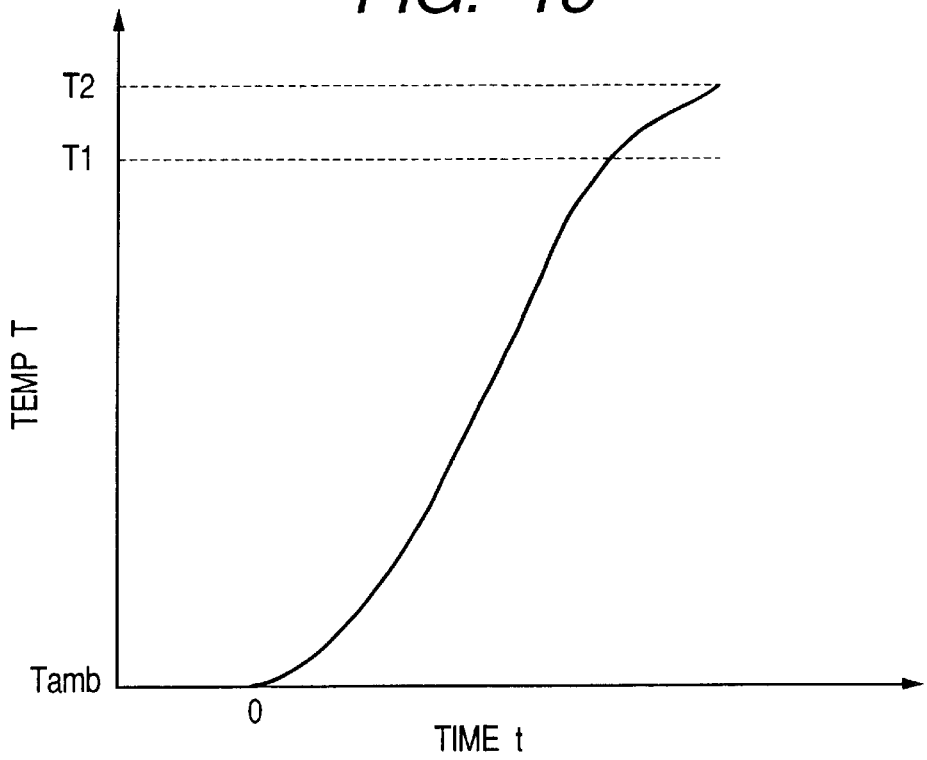
FIG. 16 is a graph showing a change in temperature of ink in contact with a heating element surface for heating ink.

The above bubble communication discharge method will be described below with reference to FIGS. 15A and 15B. FIGS. 15A and 15B show recording heads and their discharge methods, to each of which the above bubble communication discharge method can suitably be applied, and show two examples of specific ink passage constructions of the recording heads. However, it is needless to say that the present invention is not limited to these examples of ink flow passage constructions.

The ink flow passage construction shown in FIG. 15A is provided with a heating element 10 on a substrate (not shown). By providing a top plate with partitions and grooves on this element base, a common liquid chamber C and an ink flow passage B are formed. With these, a discharge outlet 155 is formed at an end portion of the ink flow passage B. The references E1 and E2 respectively denote a selection electrode and a common electrode for applying a pulse-shaped drive signal to the heating element 10. The reference D denotes a protection layer. According to application of the above electric signal based on recording data through the electrodes E1 and E2, the heating element 10 between the electrodes E1 and E2 generates an abrupt temperature rise producing a vapor film, in a short time (about 300° C), and thereby a bubble 156 is generated. This bubble 156 grows and, in due course of time, communicates with the outside air at the end portion A on the substrate side in the discharge outlet 155.

After this communication, a stable discharged ink droplet (broken line 157) is formed. In this discharge, for the reasons of rapidly performing refilling for the subsequent discharge because the bubble 156 does not completely block the ink passage B in its growing process (ink within the ink passage B is continuous to ink projecting beyond the discharge outlet 155), and the heat of the bubble that has reached a relatively high temperature not less than 300° C is also discharged into the outside air, etc., even great problems due to heat storage (reduction of ink viscosity or unstable bubble formation due to heat storage) do not arise, and the drive duty of each heating element can be made high.

Although FIG. 15B shows no common liquid chamber C, an ink passage B has a curved shape, and a heating element 10 is provided on the element base surface at the curved portion. A discharge outlet 155 has a shape decreasing in cross section in the discharge direction, and its opening is provided opposite to the heating element 10. This discharge outlet 155 is formed in an orifice plate OP.

Also in FIG. 15B, like the construction of FIG. 15A, a vapor film (about 300° C) is produced to generate a bubble 156. By this bubble formation, ink of the thickness portion of the orifice plate OP is pushed away in the discharge direction to make the ink of that portion thin. After this, the bubble 156 communicates with the outside air in the range from the periphery A1 on the outside air side of the discharge outlet 155 to the area A2 near the discharge outlet on the inner side. At this time, the growth of the bubble 156 does not block the ink passage, ink that need not move toward the discharge direction can be left as a continuous body continuous with ink within the ink passage B, and it can be realized to stabilize the discharge quantity and discharge velocity of the ink droplet 157.

According to such a bubble communication discharge method, since bubble formation in the vicinity of the discharge outlet can be performed suddenly and surely, with help of refilling performance by the ink passage in the above non-blocked state, highly stable and high-speed recording can be attained. Besides, by making the bubble communicate with the outside air, the defoaming process of the bubble does not occur, and damage of the heating element or substrate due to cavitation can be prevented.

The driving method of ink-jet recording according to the present invention will be described below using the drive signal examples shown in FIGS. 11 to 13.

EXAMPLE 3

In this example, the same recording head as that shown in FIG. 2 was used. The lives of bubbles were measured using the drive signal waveform of FIG. 11. In this example, W11=0.3 μsec, WS11=0.5 μsec, and W12=0.8 μsec. The surface temperature Tp of the heating element by the first drive signal was about 130° C. The foaming time δt was 0.5 μsec, and the foaming time of the single pulse drive of FIG. 7, at which the temperature rise rate dT(t0) was the same, was tg=1 μsec. From FIG. 9, ts was 1.8 μsec. A thousand lives for 10 seconds were measured at the drive frequency of 100 Hz at this time, and the ratio ($\Delta\tau/|\tau|$) of the life time dispersion Δτ to the mean life |τ| was examined. As the result, when $\Delta\tau/|\tau|$ at δt=0.5 μsec was compared with $\Delta\tau/|\tau|$at tg=1.8 μsec in case of the single pulse drive, the former was half or less the latter. By using the drive waveform of this example, foaming could be established.

Next, by calculating the cube of the ratio of the life (20 μsec) according to the drive signal of the present invention to the life (12 μsec) according to the single pulse drive signal of tg=0.5 μsec, the contribution of the second drive signal to foaming energy was obtained. It was 22%.

From the above, by the driving method of the present invention, the thickness of the overheated liquid layer could almost be determined by heating according to the first drive signal, and foaming energy could be controlled independently of the second signal to operate as a trigger for stabilizing foaming.

EXAMPLE 4

In this example, the same recording head as that shown in FIG. 2 was used. The lives of bubbles were measured using the drive signal waveform of FIG. 12. In this example, W21=0.5 μsec, WS21=0.5 μsec, n=2, WS22=2.0 μsec, and W22=0.8 μsec. Thee surface temperature Tp of the heating element by the first drive signal was about 200° C. The foaming time δt was 0.3 μsec, and the foaming time of the single pulse drive of FIG. 7, at which the temperature rise rate dT(tO) was the same, was tg=0.8 μsec.

From FIG. 9, ts was 1.8 μsec. A thousand lives for 10 seconds were measured at the drive frequency of 100 Hz at this time, and the ratio ($\Delta\tau/|\tau|$) of the life time dispersion Δτ to the mean life |τ| was examined. As the result, when $\Delta\tau/|\tau|$ of this example was compared with $\Delta\tau/|\tau|$ at tg=1.8 μsec in case of the single pulse drive, the former was less than half the latter. By using the drive waveform of this example, foaming could be stabilized.

The life according to the drive signal of the present invention was 23 μsec. In case of tg=0.3 μsec according to the single pulse drive signal, an overcurrent flowed in the heating element because of the large heating element voltage, and the heating element broke. So, the life could not be measured. From FIG. 9, when tg=0.3 μsec, the life can be considered to be less than 10 μsec. Hence, it is believed that foaming energy can be determined almost by the first drive signal.

From the above, by the driving method of the present invention, the thickness of the overheated liquid layer could almost be determined by heating according to the first drive signal, and foaming energy could be controlled independently of the second drive signal to operate as a trigger for stabilizing foaming.

EXAMPLE 5

In this example, the same recording head as that shown in FIG. 2 was used. The lives of bubbles were measured using the drive signal waveform of FIG. 13. In this example, W31=0.3 μsec, WS31=0.3 μsec, WS32 0.5 μsec, WS33=1.0 μsec, and W32=0.7 μsec. The surface temperature Tp of the heating element due to the first drive signal was about 160° C. The foaming time δt was 0.3 μsec, and the foaming time of the single pulse drive of FIG. 7, at which the temperature rise rate dT(tO) was the same, was tg=0.6 μsec.

From FIG. 9, ts was 1.8 μsec. A thousand lives for 10 seconds were measured at the drive frequency of 100 Hz at this time, and the ratio ($\Delta\tau/|\tau|$) of the life time dispersion AI to the mean life |τ| was examined. As the result, when $\Delta\tau/|\tau|$ of this example was compared with $\Delta\tau/|\tau|$ at tg=1.8 μsec in case of the single pulse drive, the former was less than half the latter. By using the drive waveform of this example, foaming could be stabilized.

COMPARATIVE EXAMPLE 3

Next, the life according to the drive signal of the present invention was 20.8 μsec. In the case of tg=0.3 μsec according to the single pulse drive signal, an overcurrent flowed in the heating element because of the large heating element voltage, and the heating element broke. So, the life could not be measured. From FIG. 9, when tg=0.3 μsec, the life can be considered to be less than 10 μsec. Hence, it is believed that foaming energy can be determined almost by the first drive signal.

From the above, by the driving method of the present invention, the thickness of the overheated liquid layer could almost be determined by heating according to the first drive signal, and foaming energy could be controlled independently of the second drive signal to operate as a trigger for stabilizing foaming.

Besides, by using the driving method of the present invention, the life of the bubble almost equal to that in the case of the single rectangular pulse drive of tg=1.8 μsec could be obtained, and it was possible to ensure sufficient foaming energy.

EXAMPLE 6

This example shows an example of applying the communication discharge method described with reference to FIGS. 15A and 15B. A recording head in the form of FIG. 15B was used.

As a substrate, a p-type silicon wafer with its crystal orientation (100) was used. This wafer was thermally oxidized to form a 0.6 μm-thick silicon dioxide film. On this silicon dioxide film a 0.7 μm-thick PSG film was deposited by normal pressure CVD method, and further a plasma silicon oxide (p-SiO) film was deposited thereon by plasma CVD method. On this substrate were formed a thin film resistance element for a heating element made of Ta-N, and wiring electrodes of A1-Cu for applying a drive signal to the thin film resistance element. A 0.2 μm-thick plasma silicon nitride (p-SiN) film was formed as a protection film on the thin film resistance element, and further a 2300 Å-thick Ta film tolerable to cavitation erosion and corrosion due to electrochemical reaction was formed on the plasma silicon nitride (p-SiN) film. On this heating element, an orifice plate was provided to form an ink passage and a discharge outlet plate. A through- hole was formed in the substrate by etching from the back surface by anisotropic etching of silicon. This through-hole was used as an ink supply port. The size of the thin film resistance element was 26 μm ×32 μm, the size of the discharge outlet was 23 μm ×23 μm, the height of the ink passage was 12 μm, and the height from the thin film resistance element to the discharge outlet side end was 20 μm. The sheet resistance of the heating element was 53 Ω/□. Forty-eight recording heads each having the above construction were disposed in a density of 360 per inch.

Using this recording head, the discharge velocities of droplets and the velocity dispersion according to the driving method of the present invention using the drive signal waveform of FIG. 11 were measured. The ink used was the same as that described with reference to FIG. 2. The drive signal voltage was set to be 1.1 times the minimum voltage that a bubble was generated. Table 1 below shows the discharge velocities of droplets measured. Each discharge velocity shown was the mean of all discharge velocities when discharge was performed 1000 times. While changing the pulse width according to a single drive signal, the foaming time at which discharge velocity decreased was measured. The discharge velocity started to decrease from tg=1.5 μsec, and sufficient foaming energy could not be obtained. Pulse width conditions of drive signals of the drive according to the single pulse and the driving method of the present invention are shown below.

TABLE 1

| | W11 (μsec) | WS11 (μsec) | W12 (μsec) | discharge velocity (m/sec) |
|---|---|---|---|---|
| comparative example 4 | 0 | 0 | 1.5 | 16.0 |
| comparative example 5 | 0 | 0 | 0.42 | 11.4 |
| example 6 | 0.3 | 0.2 | 0.3 | 16.5 |

In comparison with the discharge velocity of the comparative example 4, the discharge velocity of the comparative example 5 of rapid heating decreased to two- thirds. Since the kinetic energy of a droplet is in proportion to foaming energy and to the square of discharge velocity, from the table 1, it decreased nearly 50%. In the example 4 of the driving method of the present invention, the discharge velocity was greater than that of the comparative example 4. In comparison with the comparative example 5 of rapid heating, the discharge velocity was 1.44 times in spite of the shorter applying time of the drive pulse of the second drive signal.

Next, from the measurement of the discharge velocities, when the discharge velocity variation quantity, which is the value of the variation width of the discharge velocities divided by the mean of the discharge velocities, was measured, in the example 6, the value decreased to one-third in comparison with that of the comparative example 4.

From the above, by the driving method of the present invention, the thickness of the overheated liquid layer could almost be determined by heating according to the first drive signal, and foaming energy could be controlled independently of the second drive signal to operate as a trigger for stabilizing foaming.

As described above, according to the driving method and the recording apparatus of the present invention described above, foaming energy can be made sufficiently high while reducing the fluctuation of foaming energy because a bubble generated in ink can be formed stably. This makes it possible to improve the discharge performance of ink, such as the discharge velocity of ink. As a result, a high-quality image can be obtained.

What is claimed is:

1. A driving method of an ink-jet recording head which comprises a discharge outlet for discharging ink, an ink flow passage communicating with said discharge outlet, and a heating element for heating the ink in the ink flow passage by applying a drive signal so as to generate a bubble, the head discharging the ink through the discharge outlet on the basis of the generation of the bubble, wherein the drive signal comprises a first drive signal for storing foaming energy in the ink, and a second drive signal for generating a bubble in the ink, and the bubble is generated by applying, to the heating element, the drive signal in which:

when the time, from application start of the second drive signal to bubble generation is δt, and the boundary foaming time, at which foaming energy decreases in case of generating a bubble only by the second drive signal without applying the first drive signal, is ts, δt and ts satisfy the relation:

$$\delta t < ts;$$

and, when the applying time of the first drive signal, which is the difference in time from the time at which application of the first drive signal is started to the time at which the second drive signal is started, is t1, the applying time of the second drive signal is (t2- t1), and the heating quantity of the heating element by the drive signal is Q(t), t1, t2, and Q(t) satisfy:

$$\frac{1}{t1}\int_0^{t1} Q(t)\,dt < \frac{1}{\delta t}\int_{t1}^{t2} Q(t)\,dt.$$

2. A driving method of an ink-jet recording head in which heat is generated by applying a drive signal to a heating element, and the heat is supplied to ink to generate a bubble and discharge the ink through a discharge outlet, wherein the drive signal comprises a first drive signal for storing foaming energy in the ink, and a second drive signal for generating a bubble in the ink, and the second drive signal of a duration shorter than the boundary foaming time ts, at which foaming energy decreases in case of performing foaming only by the second drive signal, is used, and the first drive signal for compensating for a decrease in the foaming energy by causing a surface temperature of the heating element to be equal to or higher than a boiling point of the ink is applied prior to the second drive signal.

3. A method according to claim 1 or 2, wherein, when the time at which the bubble is generated by the second drive signal is δt, the temperature rise rate at this time is dT(δt), the boundary foaming time at which foaming energy decreases in case of generating a bubble only by the second drive signal without applying the first drive signal is ts, and the temperature rise rate at this time is dT(ts), each temperature rise rate satisfies:

$$dT(\delta t) > dT(ts).$$

4. A method according to claim 1 or 2, wherein the first drive signal is for increasing the thickness of an overheated ink layer in the ink receiving heat from the heating element.

5. A method according to claim 1 or 2, wherein the surface temperature of the heating element before applying the second drive signal is heated to the boiling temperature or higher by the first drive signal.

6. A method according to claim 5, wherein, when the time from application start of the second drive signal to bubble generation is δt, the boundary foaming time at which foaming energy decreases in case of generating a bubble only by the second drive signal without applying the first drive signal is ts, the boiling point of the ink is Tb, the foaming temperature is Tg, and the temperature of the ink before applying the first drive signal is Tamb, δt satisfies:

$$\delta t < \frac{Tg - Tb}{Tg - Tamb} \cdot ts.$$

7. A method according to claim 1, wherein the ratio J1/J0 of the foaming energy J1 of a bubble formed only by the second drive signal without applying the first drive signal to the foaming energy J0 of a bubble formed by the first and second drive signals satisfies:

$$J1/J0 \times 100 < 50\ (\%).$$

8. A method according to claim 1 or 2, wherein the heating quantity of the heating element by the second drive signal is equal to or more than the heating quantity of the heating element at the boundary foaming time ts, at which foaming energy decreases in case of generating a bubble only by the second drive signal without applying the first drive signal.

9. A method according to claim 1 or 2, wherein ts is the boundary foaming time when the life of a bubble becomes reduced.

10. A method according to claim 1 or 2, wherein ts is the boundary foaming time when the discharge velocity becomes reduced.

11. A method according to claim 1 or 2, wherein the first and second drive signals are continuous.

12. A method according to claim 1 or 2, wherein a resting period is interposed between the first and second drive signals.

13. A method according to claim 12, wherein the first drive signal comprises a plurality of pulses, and the resting periods between the plurality of pulses gradually become longer.

14. An ink-jet recording apparatus for performing recording using an ink-jet recording head that comprises a discharge outlet for discharging ink, an ink flow passage communicating with the discharge outlet, and a heating element for heating the ink in the ink flow passage by applying a drive signal to generate a bubble, the head discharging ink through the discharge outlet on the basis of the generation of the bubble, said apparatus utilizing a first drive signal for storing foaming energy in the ink, and a second drive signal for generating the bubble in the ink, said apparatus comprising:

drive signal applying means for applying, to the heating element, the drive signal in which:

when the time from application of start of the second drive signal to bubble generation is δt, and the boundary foaming time, at which foaming energy decreases in case of generating a bubble only by the second drive signal without applying the first drive signal, is ts, δt and ts satisfy the relation:

$$\delta t < ts;$$

and, when the applying time of the first drive signal, which is the difference in time from the time at which application of the first drive signal is started to the time at which the second drive signal is started, is t1, the applying time of the second drive signal is (t2- t1), and the heating quantity of the heating element by the drive signal is Q(t), t1, t2, and Q(t) satisfy:

$$\frac{1}{t1}\int_0^{t1} Q(t)\,dt < \frac{1}{\delta t}\int_{t1}^{t2} Q(t)\,dt.$$

15. An ink-jet recording apparatus in which heat is generated by applying a drive signal to a heating element, and the heat is supplied to ink to generate a bubble and discharge the ink through a discharge outlet, said apparatus comprising:

signal applying means for applying the drive signal to the heating element, the drive signal comprising a first drive signal for storing foaming energy in the ink, and a second drive signal for generating the bubble in the ink, the second drive signal having a duration shorter than the boundary foaming time ts at which foaming energy decreases in case of performing foaming only by the second drive signal, the first drive signal being applied prior to the second drive signal so as to compensate for a decrease in the foaming energy by causing a surface temperature of the heating element to be equal to or higher than a boiling point of the ink.

16. An apparatus according to claim 14 or 15, wherein the first drive signal is for increasing the thickness of an overheated ink layer in the ink receiving heat from the heating element.

17. An apparatus according to claim 14 or 15, wherein the surface temperature of the heating element before applying the second drive signal is heated to the boiling temperature or higher by the first drive signal.

18. An apparatus according to claim 17, wherein, when the time from application start of the second drive signal to bubble generation is δt, the boundary foaming time, at which foaming energy decreases in case of generating a bubble only by the second drive signal without applying the first drive signal, is ts, the boiling point of the ink is Tb, the foaming temperature is Tg, and the temperature of the ink before applying the first drive signal is Tamb, δt satisfies:

$$\delta t < \frac{Tg - Tb}{Tg - Tamb} \cdot ts.$$

19. An apparatus according to claim 14 or 15, wherein the heating quantity of the heating element by the second drive signal is equal to or more than the heating quantity of the heating element at the boundary foaming time ts at which foaming energy decreases in case of generating a bubble only by the second drive signal without applying the first drive signal.

20. An apparatus according to claim 14 or 15, wherein ts is the boundary foaming time when the life of a bubble becomes reduced.

21. An apparatus according to claim 14 or 15, wherein ts is the boundary foaming time when the discharge velocity becomes reduced.

22. An apparatus according to claim 14 or 15, wherein the first and second drive signals are continuous.

23. An apparatus according to claim 14 or 15, wherein a resting period is interposed between the first and second drive signals.

* * * * *

UNITED STATES PATENT AND TRADEMARK OFFICE

CERTIFICATE OF CORRECTION

PATENT NO. : 6,447,085 B1 
DATED : September 10, 2002
INVENTOR(S) : Yagi et al.

It is certified that error appears in the above-identified patent and that said Letters Patent is hereby corrected as shown below:

Column 10,
Line 65, “driving- force” should read -- driving-force --.

Column 12,
Line 61, “At” should read -- $\Delta t$ --.

Column 14,
Line 11, “$\Delta\delta$” should read -- $\Delta\tau$ --.
Line 35, “50,to” should read -- 50 to --.
Line 63, “bt” should read -- $\delta t$ --.

Column 17,
Line 18, “$\Delta\tau/|\tau|$at” should read -- $\Delta\tau/|\tau|$ at --.

Column 18,
Line 65, “through- hole” should read -- through-hole --.

Column 19,
Line 37, “two- thirds.” should read -- two-thirds. --.

Signed and Sealed this

First Day of April, 2003

JAMES E. ROGAN
*Director of the United States Patent and Trademark Office*